US006386814B2

(12) United States Patent
Song

(10) Patent No.: US 6,386,814 B2
(45) Date of Patent: May 14, 2002

(54) COVER MOUNTABLE TO BEVERAGE CONTAINER AND MOUNTING METHOD AND APPARATUS THEREOF

(75) Inventor: Jong Hoon Song, Paju (KR)

(73) Assignee: Kangsan Technologies, LTD, Seoul (KR)

( * ) Notice: Subject to any disclaimer, the term of this patent is extended or adjusted under 35 U.S.C. 154(b) by 0 days.

(21) Appl. No.: 09/853,810

(22) Filed: May 11, 2001

Related U.S. Application Data

(62) Division of application No. 09/534,203, filed on Mar. 24, 2000.

(30) Foreign Application Priority Data

| | | |
|---|---|---|
| Aug. 25, 1999 | (KR) | 99-35332 |
| Nov. 17, 1999 | (KR) | 99-51022 |
| Dec. 17, 1999 | (KR) | 99-58534 |
| Jan. 25, 2000 | (KR) | 00-2006 |
| Feb. 29, 2000 | (KR) | 00-5570 |
| Feb. 29, 2000 | (KR) | 00-5571 |

(51) Int. Cl.[7] ..... B21D 51/44

(52) U.S. Cl. ..... 413/14; 413/2; 413/12; 53/410

(58) Field of Search ..... 413/2, 12, 14, 413/53, 54, 26, 27, 45, 52, 56, 66, 78; 53/420, 410, 489, 128.1, 139.5; 220/713, 714, 715, 716, 709, 906

(56) References Cited

U.S. PATENT DOCUMENTS

| | | | | | |
|---|---|---|---|---|---|
| 4,026,226 | A | * | 5/1977 | Hahn et al. | 413/12 |
| 4,092,940 | A | * | 6/1978 | Wu et al. | 413/52 |
| 4,136,629 | A | * | 1/1979 | Luthi | 413/14 |
| 4,213,537 | A | * | 7/1980 | Caccavale | 220/215 |
| 4,717,039 | A | * | 1/1988 | Ayyoubi | 220/253 |
| 4,852,763 | A | | 8/1989 | Dimberio | |
| 4,880,136 | A | | 11/1989 | Englert | |
| 4,927,048 | A | | 5/1990 | Howard | |
| 5,071,019 | A | | 12/1991 | Sizemore | |
| 5,142,769 | A | * | 9/1992 | Gold et al. | 413/56 |
| 5,421,472 | A | * | 6/1995 | Beckertgis | 220/253 |
| 5,692,616 | A | | 12/1997 | Baker | |
| 5,707,196 | A | * | 1/1998 | Brucker | 413/53 |
| 5,720,412 | A | | 2/1998 | Ficken | |
| 5,893,489 | A | * | 4/1999 | Giarrante | 220/254 |

* cited by examiner

*Primary Examiner*—Stephen F. Gerrity
*Assistant Examiner*—Louis Huynh
(74) *Attorney, Agent, or Firm*—Kinney & Lange, P.A.

(57) ABSTRACT

Disclosed is a cover mountable to a beverage container and mounting method and apparatus thereof. The container cover detachably mountable to an upper surface of a beverage container comprises a body which is formed to have substantially a disc-shaped configuration. The body is partly cut away from an edge toward a center thereof thereby to define a beverage discharging opening which has a predetermined width and a predetermined contour. The beverage discharging opening is capable of being selectively communicated with a discharging hole of the beverage container as the body is rotated. An inner end of the beverage discharging opening is delimited by a rotation guiding part which has a predetermined curvature to guide rotation of the body. The body has a straw insertion hole which is defined therein at a predetermined location to have a predetermined diameter in a manner such that a straw can be inserted therethrough. The body further has an advertisement surface which has a predetermined area in a manner such that an advertising design, letters, and so forth can be printed or an attachment can be affixed thereon.

14 Claims, 22 Drawing Sheets

A-A LINE CROSS-SECTION

B-B LINE CROSS-SECTION

C-C LINE CROSS-SECTION

D-D LINE CROSS-SECTION

D-D LINE CROSS-SECTION

E-E LINE CROSS-SECTION

F-F LINE CROSS-SECTION

COVER MOUNTABLE TO BEVERAGE CONTAINER AND MOUNTING METHOD AND APPARATUS THEREOF

CROSS-REFERENCE TO RELATED APPLICATION (S)

The present application is a divisional application of non-provisional application Ser. No. 09/534,203 filed Mar. 24, 2000 entitled "COVER MOUNTABLE TO BEVERAGE CONTAINER AND MOUNTING METHOD AND APPARATUS THEREOF."

BACKGROUND OF THE INVENTION

1. Field of the Invention

The present invention relates to a cover mountable to a beverage container and a mounting method and apparatus thereof, and more particularly, the present invention relates to a cover mountable to a beverage container and a mounting method and apparatus thereof, wherein the cover is mounted to an upper surface of a container end which is coupled to an upper end of the beverage container and on which a pull tab is installed to be used when opening a discharging hole defined in the upper surface of the container end, in a manner such that the cover can selectively close and open the discharging hole in a state that the discharging hole is initially opened.

2. Description of the Related Art

Conventionally, a metal can is widely used as a beverage container throughout the world in view of its portability and storability. In general, the metal can is, as shown in FIG. 1, made of aluminum or a thin plate which is coated with aluminum. In its construction, the metal can comprises a body 10 which is formed to have a cylindrical configuration so that a beverage is accommodated therein, and a container end 20 which is coupled to an upper end of the body 10.

The container end 20 is formed with a discharging hole 22 through which the beverage can be discharged out of the beverage container. A capping device for the discharging hole 22 is installed on the container end 20. The capping device is composed of a seal plate 24*a* which is integrally formed with the container end 20 upon forming the container end 20 to close the discharging hole 22, and a pull tab 24*b* which is securely installed on an upper surface of the container end 20 by a central pin 26 in a manner such that it can depress downward the seal plate 24*a* to result in pivoting movement of the seal plate 24*a* into the interior of the beverage container.

However, in the metal can constructed as mentioned above, once the discharging hole 22 is opened, it is impossible to reclose the discharging hole 22. Therefore, in the case that a period of time is lapsed in a state wherein the beverage container is opened, foreign substances can enter into the beverage container to contaminate a beverage accommodated therein. Also, if a user moves while holding the can in his hand, the likelihood of liquid spillage from the beverage container is increased.

To cope with these problems, U.S. Pat. No. 4,717,039 discloses a container cover which is integrally and rotatably coupled to an upper surface of a beverage container by a central pin and has a seal depression, a straw insertion hole and a finger grip; and U.S. Pat. No. 4,852,763 discloses a beverage container cover which is detachably and rotatably coupled to an upper surface of a beverage container and is formed with a notch.

However, the U.S. Pat. No. 4,717,039 still suffers from defects in that the container cover is integrally coupled to the upper surface of the beverage container. Therefore, because the container cover must be necessarily coupled to the beverage container upon manufacturing the beverage container, a separate assembling process is required and the construction of an existing beverage container should be modified. Specifically, since the container cover cannot be detached from the beverage container, the container cover cannot but be a permanent feature of the beverage container and, as such, it cannot be removed or reused. In this regard, due to the fact that the container cover cannot be removed from the beverage container, it is impossible for a user to see a lower surface of the container cover, and thus, the container cover cannot be effectively used for other purposes, such as a game implement or a medium for providing free gifts.

While the U.S. Pat. No. 4,852,763 can solve more or less the defects induced in the U.S. Pat. No. 4,717,039, due to the fact that the container cover is detachably coupled to the upper surface of the beverage container, it also encounters a problem in that the container cover is only formed with the notch which can be selectively communicated with a discharging hole of the beverage container. Consequently, since additional convenience factors such as a straw insertion hole through which a straw can be inserted into the beverage container, a finger grip or the like are not provided, a higher grade of satisfaction cannot be rendered to a user. Further, in both of the U.S. Pat. Nos. 4,717,039 and 4,852,763, if a lengthy period of time is lapsed while the beverage containers are circulated in the market in a state wherein the container cover is mounted to each beverage container, because potentially hazardous debris such as dust particles may be accumulated on an upper surface of the container cover, the debris can enter into the human body, whereby health conditions of the user can be deteriorated.

Also, because the straw insertion hole of the U.S. Pat. No. 4,717,039 is formed to have a predetermined diameter, in the case that a diameter of a commercially available straw does not correspond to the predetermined diameter of the straw insertion hole, the straw can play or float on the beverage rather than being fixedly maintained in place. In addition, in the case that a diameter of a commercially available straw corresponds to the predetermined diameter of the straw insertion hole, because the straw is inserted through the straw insertion hole in a vertical direction, a drinking angle of the straw cannot be easily changed, whereby a problem is caused in that the user must drink the beverage while tipping the beverage container.

On the other hand, in order to open the discharging hole 22 of the beverage container, while the pull tab 24*b* must be pulled upward thereby to depress the seal plate 24*a* downward, at this time, because the pull tab 24*b* is brought into nearly close contact with the upper surface of the container end of the beverage container, a fingernail of the user is likely to be broken or damaged in the course of pulling upward the pull tab 24*b*, whereby troublesomeness is caused in that the pull tab 24*b* cannot be easily pulled upward.

SUMMARY OF THE INVENTION

Accordingly, the present invention has been made in an effort to solve the problems occurring in the related art, and a primary object of the present invention is to provide a container cover mountable to a beverage container, which is selectively installed on an upper surface of the beverage container in a manner such that it can repeatedly close and open an opened discharging hole of the beverage container, thereby rendering a higher grade of satisfaction to a user who drinks a beverage accommodated in the beverage container, and which is constructed to have an advertisement printing zone on an upper surface thereof, thereby maximizing effectiveness of advertising.

Another object of the present invention is to provide a container cover mountable to a beverage container, which can prevent a fingernail of a user from being damaged in the course of manipulating a pull tab for opening a discharging hole of the beverage container, thereby allowing the discharging hole of the beverage container to be opened in an easier manner.

Still another object of the present invention is to provide a method and an apparatus for mounting a container cover mountable to a beverage container, which enable the container cover to be rotatably coupled to a container end of the beverage container.

In order to achieve the primary object, according to one aspect of the present invention, there is provided a container cover detachably mountable to an upper surface of a beverage container, the container cover comprising: a body formed to have substantially a disc-shaped configuration, the body being partly cut away from an edge toward a center thereof thereby to define a beverage discharging opening which has a predetermined width and a predetermined contour, the beverage discharging opening capable of being selectively communicated with a discharging hole of the beverage container as the body is rotated, an inner end of the beverage discharging opening being delimited by a rotation guiding part which has a predetermined curvature to guide rotation of the body, the body having a straw insertion hole which is defined therein at a predetermined location to have a predetermined diameter in a manner such that a straw can be inserted therethrough, the body further having an advertisement surface which has a predetermined area in a manner such that an advertising design, letters, and so forth can be printed or an attachment can be affixed thereon.

In order to achieve another object, according to another aspect of the present invention, there is provided a container cover detachably mountable to an upper end of a beverage container, the upper end of the beverage container being defined with a discharging hole and having a pull tab for opening the discharging hole, the container cover having a beverage discharging opening and a straw insertion hole, the container cover comprising: a plurality of protuberances formed on the container cover at both sides of the beverage discharging opening for allowing a user to easily rotate the container cover; a plurality of tab lifting projections formed on the container cover for lifting the pull tab as the container cover is rotated; and a filtering part formed with at least one filtering hole, the filtering part projecting upward from a plane of the container cover and being delimited by a press line which is formed therearound in a manner such that the filtering part can be depressed into the discharging hole of the upper end of the beverage container thereby to be flushed with a lower surface of the upper end of the beverage container.

In order to achieve still another object, according to still another aspect of the present invention, there is provided a method for mounting a container cover which is mountable to a beverage container, comprising the processes of: forming a body of the beverage container, in which a beverage is to be accommodated; forming a container end which is to be coupled to an upper end of the body of the beverage container and to which a pull tab for opening a discharging part and thereby defining a discharging hole is coupled, the discharging hole allowing the beverage to be discharged out of the beverage container therethrough; coupling the container end to the upper end of the body of the beverage container in a state wherein the beverage is accommodated in the body of the beverage container; forming a container cover which is composed of a body of substantially a disc-shaped configuration and is mounted to an upper surface of the container end, the body being formed with a beverage discharging opening, at least one filtering hole and a straw insertion hole; and rotatably coupling the container cover formed in the container cover forming process, between the upper surface of the container end and the pull tab, while the container end forming process is implemented.

Also, according to yet still another aspect of the present invention, there is provided a method for mounting a container cover which is mountable to a beverage container, comprising the steps of: loading a container end and moving the container end in a predetermined direction; sensing and aligning in a predetermined orientation the container end which is moved by the container end loading step; and inserting a container cover between an upper surface of the container end which is moved in an aligned state by the container end sensing and aligning step and a pull tab. To this end, there is provided an apparatus for mounting a container cover which is mountable to a beverage container, comprising: a container end loading device for loading a container end and moving the container end in a predetermined direction; a container end sensing and aligning device for sensing and aligning in a predetermined orientation the container end which is moved by the container end loading device; a container cover inserting device for inserting a container cover between an upper surface of the container end which is moved in an aligned state by the container end sensing and aligning device and a pull tab; and a container end arranging and storing device for arranging and storing in a predetermined pattern container ends each of which has the container cover inserted thereinto by the container cover inserting device.

BRIEF DESCRIPTION OF THE DRAWINGS

The above objects, and other features and advantages of the present invention will become more apparent after a reading of the following detailed description when taken in conjunction with the drawings, in which.

DETAILED DESCRIPTION OF PREFERRED EMBODIMENTS

Figure 1:
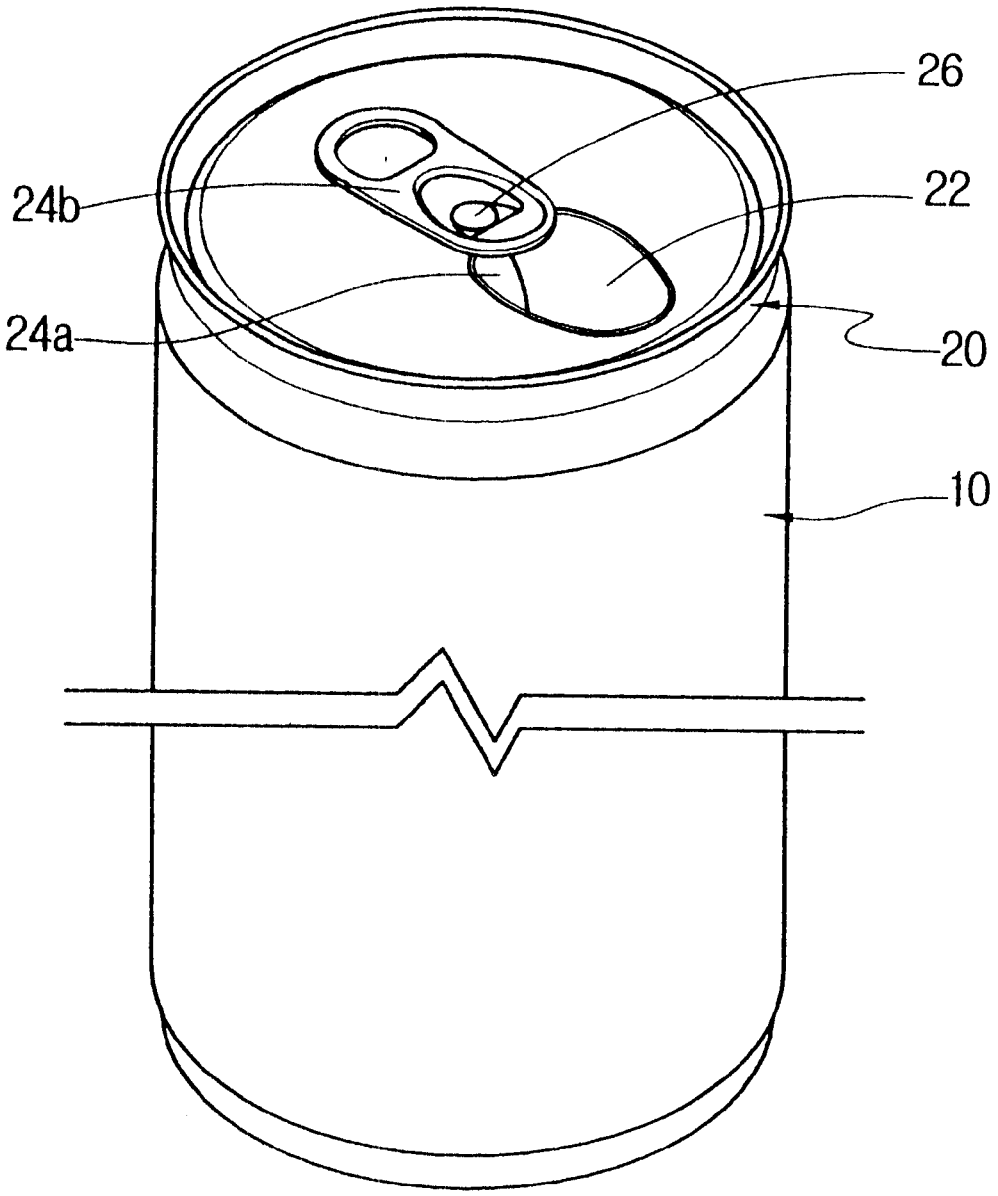
FIG. 1 is a perspective view illustrating a conventional beverage container.

Reference will now be made in greater detail to a preferred embodiment of the invention, an example of which is illustrated in the accompanying drawings. Wherever possible, the same reference numerals will be used throughout the drawings and the description to refer to the same or like parts.

Figure 2:
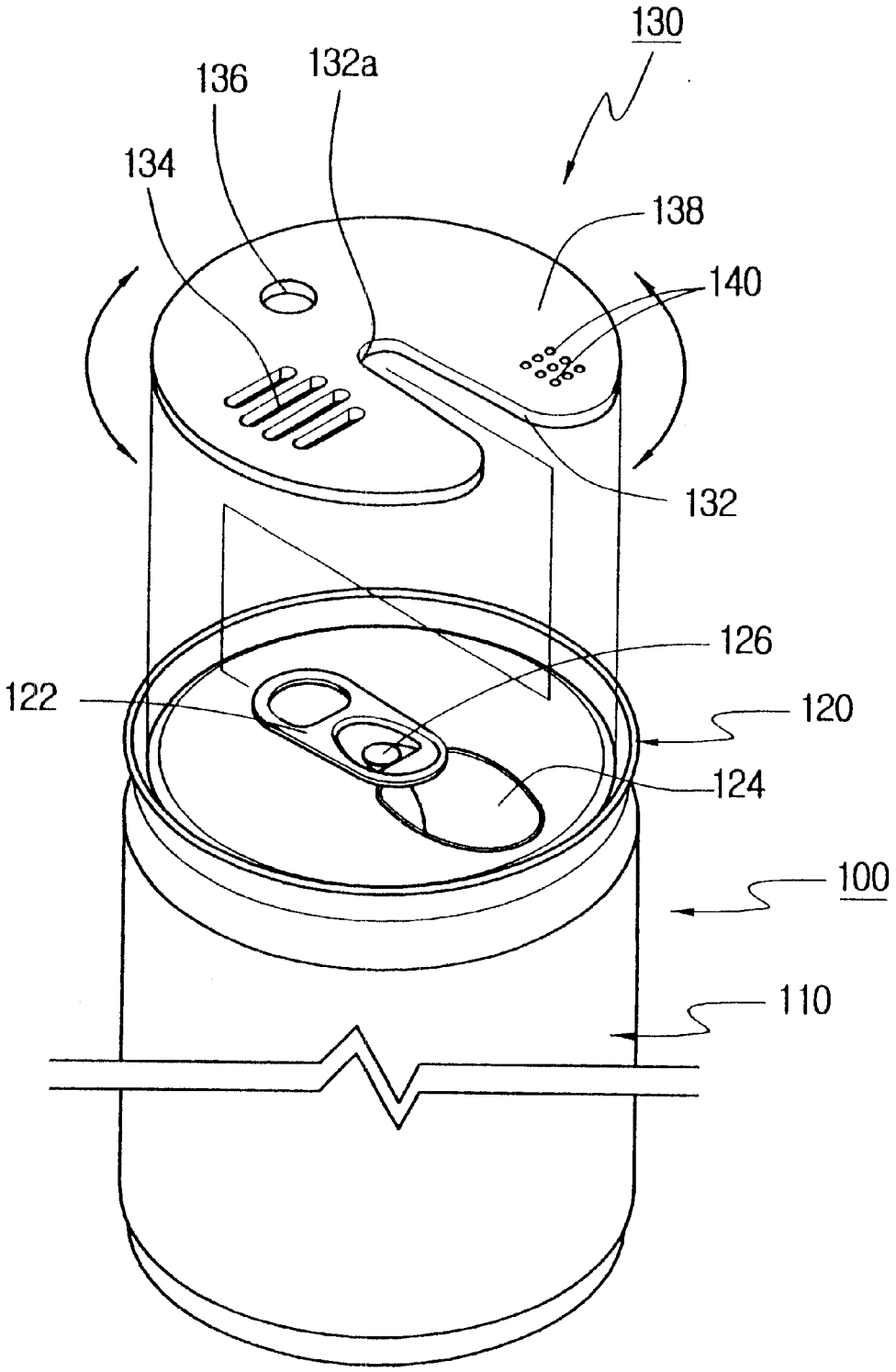
FIG. 2 is a perspective view illustrating a container cover in accordance with an embodiment of the present invention.

FIG. 2 is a perspective view illustrating a container cover in accordance with an embodiment of the present invention; FIGS. 3*a* through 3*d* are schematic plan views illustrating states wherein the container cover according to the embodiment of the present invention is used; and FIGS. 4*a* through 4*r* are views illustrating container covers according to several variations of the present invention.

As can be readily seen from FIG. 2, a beverage container 100 is formed, on an upper surface thereof, with a discharging hole 124 through which a beverage accommodated in the beverage container 100 can be discharged out of the beverage container 100. The beverage container 100 has a capping device. The capping device comprises a seal plate and a pull tab 122. The seal plate is formed in a manner such that it closes the discharging hole 124 when the discharging hole 124 has not yet been opened. The pull tab 122 is coupled to the upper surface of the beverage container 100 in a manner such that it can depress downward the seal plate to let the seal plate break free along a scored line which is formed around the seal plate. According to the present invention, a container cover 130 is provided in a manner such that it is mounted to the upper surface of the beverage container 100 thereby to selectively open and close the initially opened discharging hole 124.

The container cover 130 is rotatably installed on the upper surface of the beverage container 100. The container cover 130 comprises a body which is formed to have substantially a disc-shaped configuration. By the fact that the body is partly cut away from an edge toward a center thereof, the container cover 130 is formed with a beverage discharging opening 132 which has a predetermined width and a predetermined contour. An inner end of the beverage discharging opening 132 is delimited by a rotation guiding part 132*a* which has a predetermined curvature to guide rotation of the container cover 130. The container cover 130 has an advertisement surface 138 which is defined on an upper surface of the body having the disc-shaped configuration. The advertisement surface 138 has a predetermined area in a manner such that an advertising design or letters can be printed or an attachment can be affixed thereon.

The container cover 130 can selectively include a plurality of filtering holes 134 and a straw insertion hole 136. The plurality of filtering holes 134 are defined at a predetermined region on the upper surface of the body of the container cover 130 to have a predetermined contour, in a manner such that they can filter solid matters existing in the beverage container 100. The straw insertion hole 136 is also defined on the upper surface of the body of the container cover 130 to have a predetermined diameter, in a manner such that a straw can be inserted therethrough.

While the beverage discharging opening 132 has substantially a shape of an isosceles triangle wherein a width is gradually decreased from an entrance corresponding to a circumferential outer surface of the container cover 130 toward the rotation guiding part 132*a*, it is not limited to the shape of an isosceles triangle and instead, can be diversely varied in its shape. For example, as shown in FIG. 4*a*, the beverage discharging opening 132 can be formed with a bulged part 132*b* which has a preset curvature in a manner such that the beverage discharging opening 132 has the same contour as the discharging hole 124 of the beverage container 100 thereby to enable a front end of the pull tab 122 to easily depress the seal plate.

While it is preferred that the advertisement surface 138 is defined on a portion of the upper surface of the body of the container cover 130 to have the predetermined area, which corresponds to a left side or a right side of the beverage discharging opening 132, without adversely affecting forming positions of the beverage discharging opening 132, the plurality of filtering holes 134 and the straw insertion hole 136, the advertisement surface 138 can be defined at a variety of locations. Also, diverse advertising methods such as printing, affixing or forming can be effected on the advertisement surface 138.

While the plurality of filtering holes 134 can be formed in a manner such that they are composed of a plurality of slots which extend in a vertical direction and have different lengths and such that the plurality of slots are spaced apart one from another by a predetermined spacing, they are not limited to this arrangement, and for example, the plurality of slots can extend in a horizontal direction and a plurality of holes which have a predetermined inner diameter can be spaced apart one from another by a predetermined separation.

The straw insertion hole 136 can be formed in a manner such that it has a variety of diameters depending upon a diameter of a particular straw which is used in the beverage container 100.

On the other hand, as shown in FIG. 4*a*, a plurality of protuberances 140 are formed on the upper surface of the body of the container cover 130 for allowing a user to easily apply rotating force to the body of the container cover 130.

In this connection, a single protuberance can be projectedly formed on the body of the container cover 130, or the plurality of protuberances 140 can be projectedly formed on the body of the container cover 130 in a manner such that they are spaced apart one from another by a predetermined distance. The single protuberance or the plurality of protuberances 140 can be formed at a predetermined region on the body of the container cover 130, without adversely affecting forming positions of the beverage discharging opening 132, the advertisement surface 138, the plurality of filtering holes 134 and the straw insertion hole 136. Also, while, in the present invention, the plurality of protuberances 140 are projectedly formed on the body of the container cover 130, a person skilled in the art will readily recognize that the plurality of protuberances 140 can be depressedly formed on the body of the container cover 130.

Figure 3A:
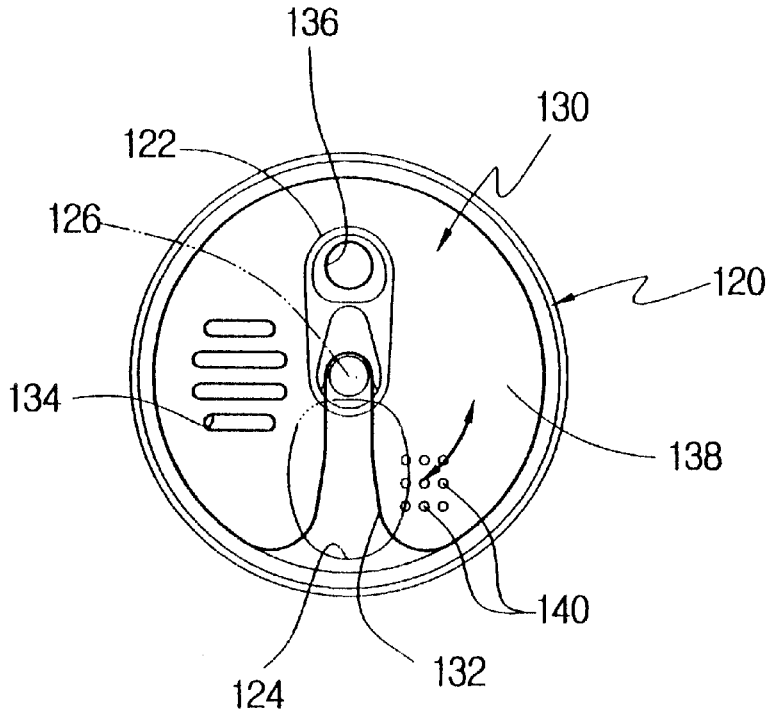
FIGS. 3*a* through 3*d* are schematic plan views illustrating states wherein the container cover according to the embodiment of the present invention is used.
Figure 4A:
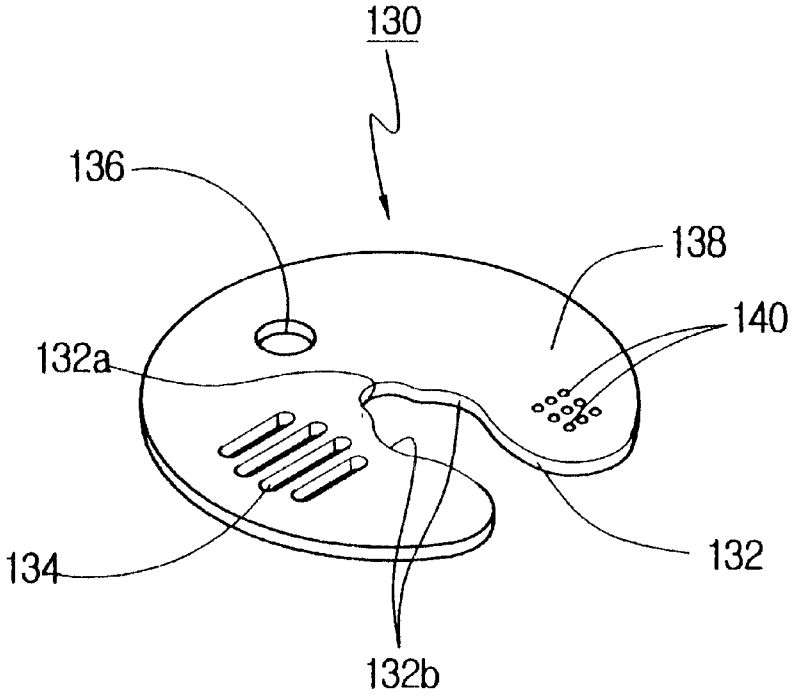
FIGS. 4*a* through 4*r* are views illustrating container covers according to several variations of the present invention.

As shown in FIG. 3*a*, in a state wherein the aforementioned container cover 130 is mounted to the upper surface of the beverage container 100 of which the discharging hole 124 is opened, if the user pulls upward the pull tab 122 in order to drink the beverage, the seal plate (later, described as a "discharging part") breaks free along the scored line which is formed therearound while pivoting downward, whereby the discharging hole 124 is defined. In this state, when the user drinks the beverage, the beverage is discharged out of the beverage container 100 through the beverage discharging opening 132 which is arranged to be communicated with the discharging hole 124.

Figure 3B:
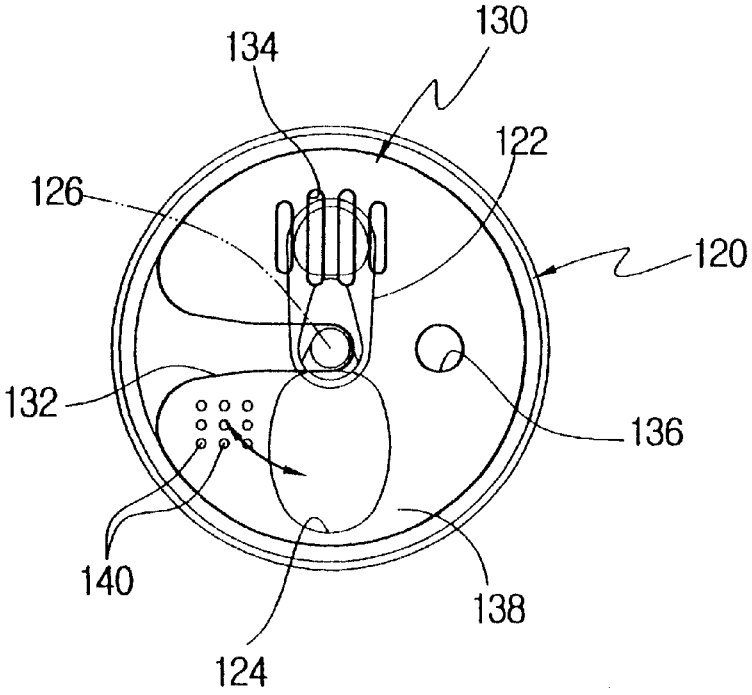

If the user moves to a certain place while holding in his hand the beverage container 100 laden with still-unconsumed beverage or it is necessary to interrupt drinking of the beverage and leave the beverage container 100 laden with still-unconsumed beverage in a moving vehicle, as shown in FIG. 3*b*, by rotating the container cover 130 to cause a closure surface which is defined at a side of the beverage discharging opening 132, to close the discharging hole 124, it is possible to prevent some gaseous ingredients contained in the beverage from being discharged into the atmospheric air and foreign substances suspended in the atmosphere from entering into the beverage container 100. Further, it is possible to inhibit spillage of the beverage even when the beverage container 100 is overturned.

Figure 3C:
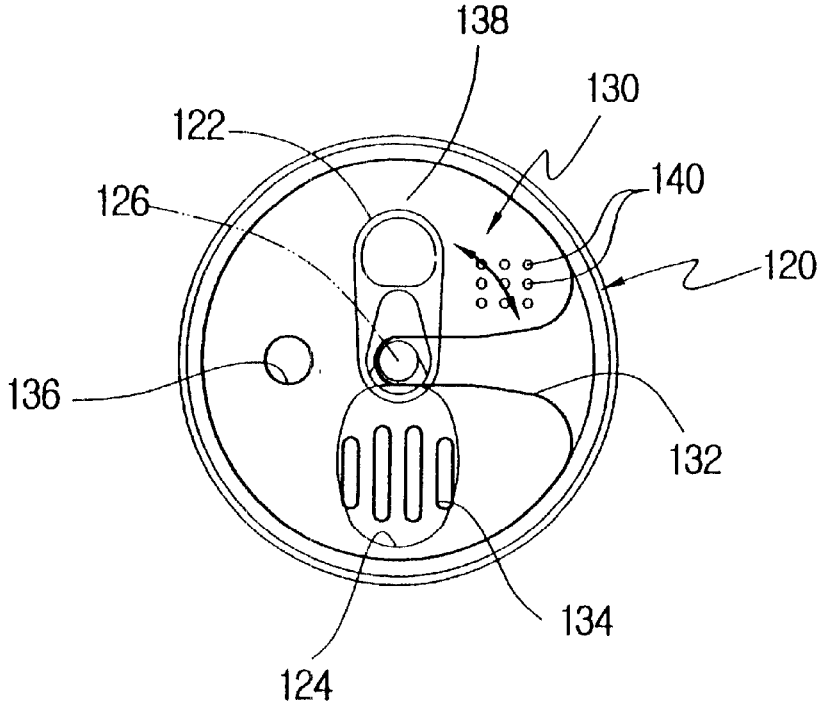

Also, for example, in the case that a beverage which is made by grinding vegetables and fruits is accommodated in the beverage container 100 so that solid matters exist in the beverage, if the user does not want to drink the solid matters existing in the beverage, as shown in FIG. 3*c*, the container cover 130 is rotated so that the plurality of filtering holes 134 are positioned above the discharging hole 124. By doing this, when the user drinks the beverage, the solid matters are filtered by a filtering part which includes the plurality of filtering holes 134, and only liquid beverage is discharged through the plurality of filtering holes 134, whereby it is possible to suit the user's taste.

Figure 3D:
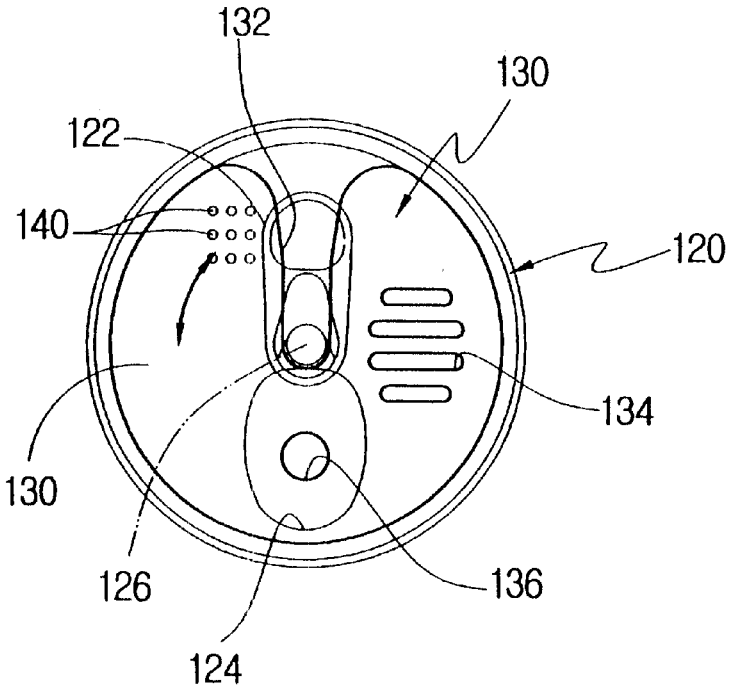

Further, even in the case that a child wants to drink the beverage using a straw, as shown in FIG. 3*d*, by rotating the container cover 130 so that the straw insertion hole 136 is positioned above the discharging hole 124, the straw can be inserted into the beverage container 100 through the straw insertion hole 136 and the discharging hole 124.

In the meanwhile, as shown in FIG. 4*a*, in a structure in which the plurality of protuberances 140 are formed on the upper surface of the container cover 130, since rotating force can be easily transferred to the container cover 130, the rotation of the container cover 130 can be implemented in an easier manner. Also, as can be readily seen from the same drawing, in a structure in which the bulged part 132*b* is formed in the beverage discharging opening 132, because the front end of the pull tab 122 of the capping device can easily depress the seal plate thereby to open the discharging hole 124, even in the case that the container cover 130 is mounted to the beverage container 100 before the discharging hole 124 is opened, the discharging hole 124 can be easily opened by pulling upward the pull tab 122.

Figure 4B:
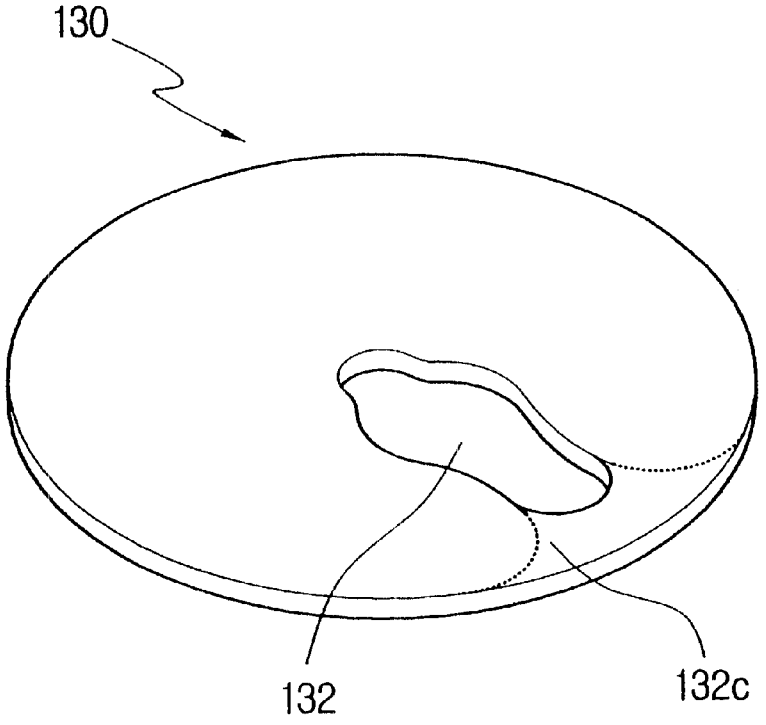

On the other hand, as shown in FIG. 4*b*, the container cover 130 is configured in a manner such that a connecting part 132*c* is formed along a portion of the circumferential outer surface of the container cover 130, which corresponds to an outer end of the beverage discharging opening 132, thereby to close the outer end of the beverage discharging opening 132. According to this, by the closing function of the connecting part 132*c*, it is possible to prevent foreign substances from accumulating on an inner edge portion of a container end 120. Also, upon drinking the beverage, because the lip is brought into contact with an upper surface of the connecting part 132*c*, uncomfortableness which can be induced to the user due to contact with the sharp edge portion of the beverage container 100, can be avoided.

Figure 4C:
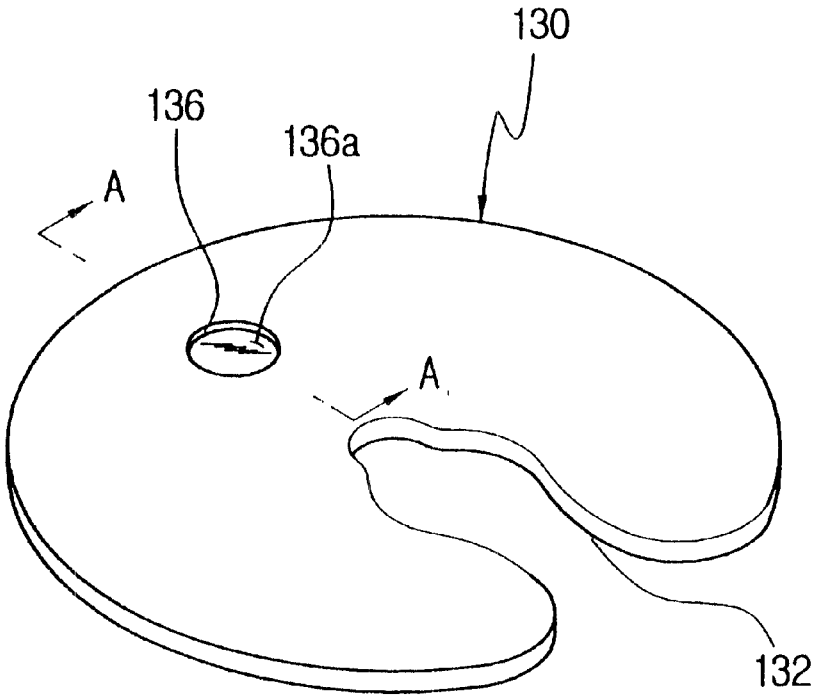
Figure 4D:
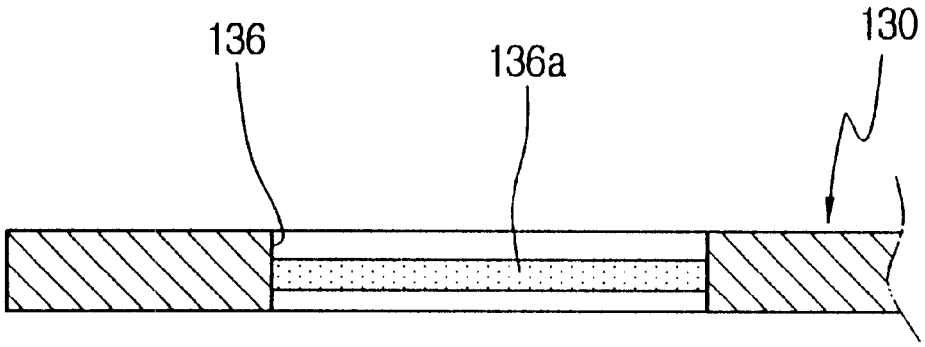

In addition, as shown in FIGS. 4*c* and 4*d*, the container cover 130 is configured in a manner such that a film member 136a is provided in the straw insertion hole 136 in a manner such that it closes the straw insertion hole 136 and is torn when the straw is inserted through the straw insertion hole 136. Hence, it is possible to prevent foreign substances from accumulating on the upper surface of the beverage container 100 through the straw insertion hole 136. Upon drinking the beverage using the straw, when the film member 136*a* is torn by an end of the straw and the straw is inserted through the straw insertion hole 136, because the torn film member 136*a* is squeezed against a circumferential outer surface of the inserted straw, the straw is prevented from playing or floating in the beverage, whereby it is possible to conveniently drink the beverage.

Figure 4E:
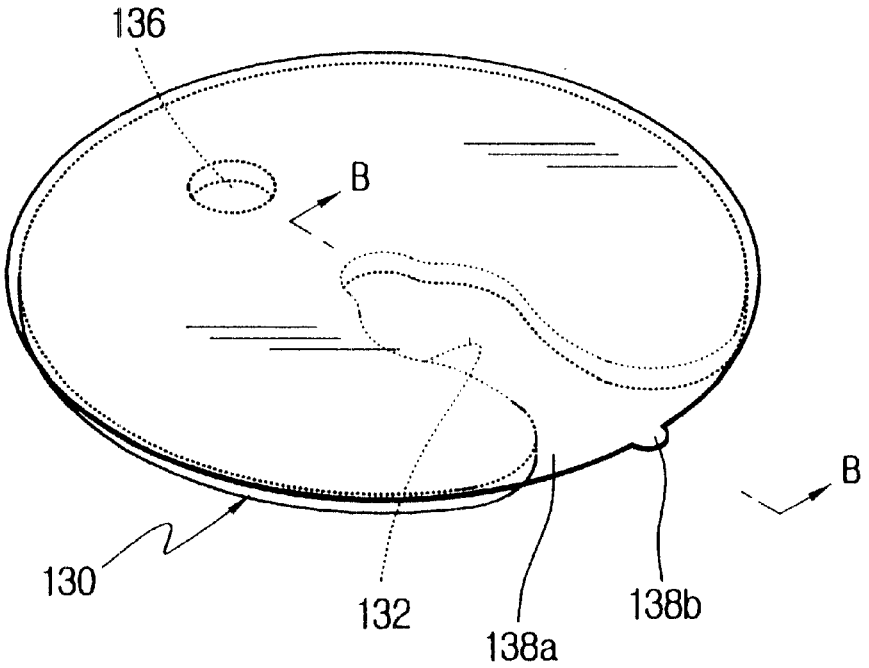
Figure 4F:
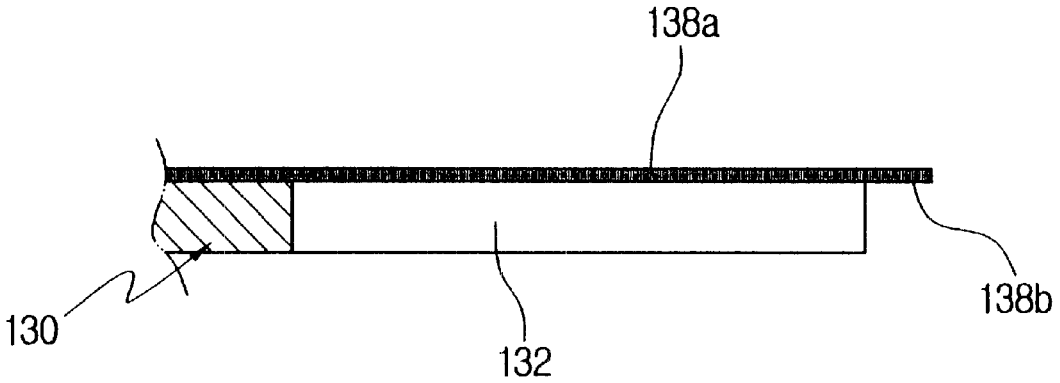
Figure 4G:
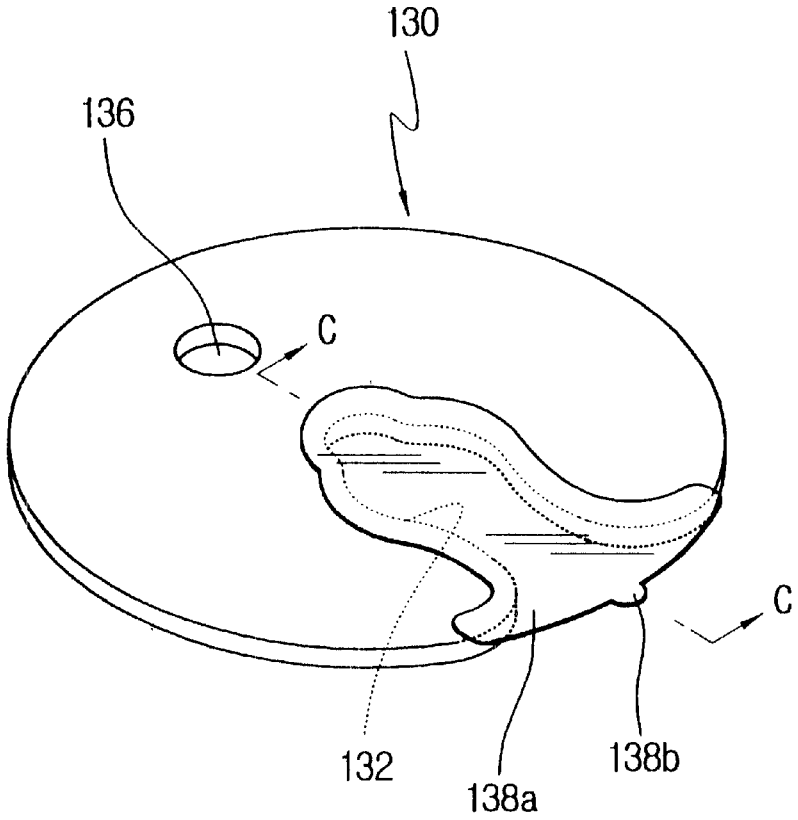
Figure 4H:
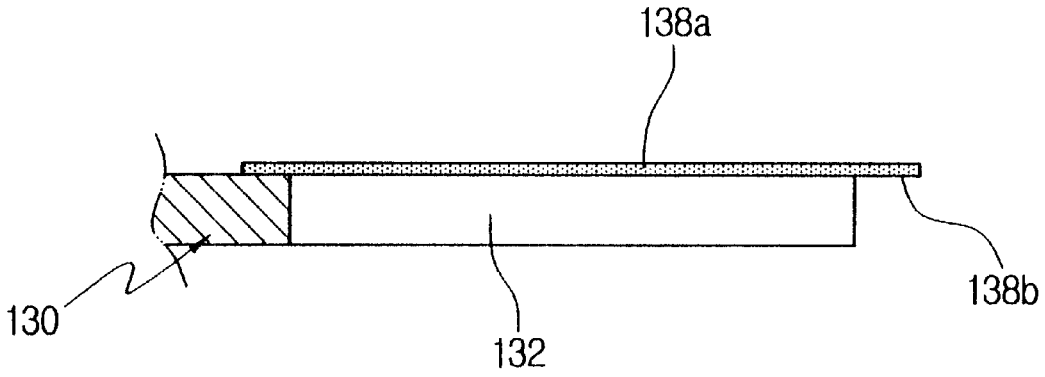
Figure 4I:
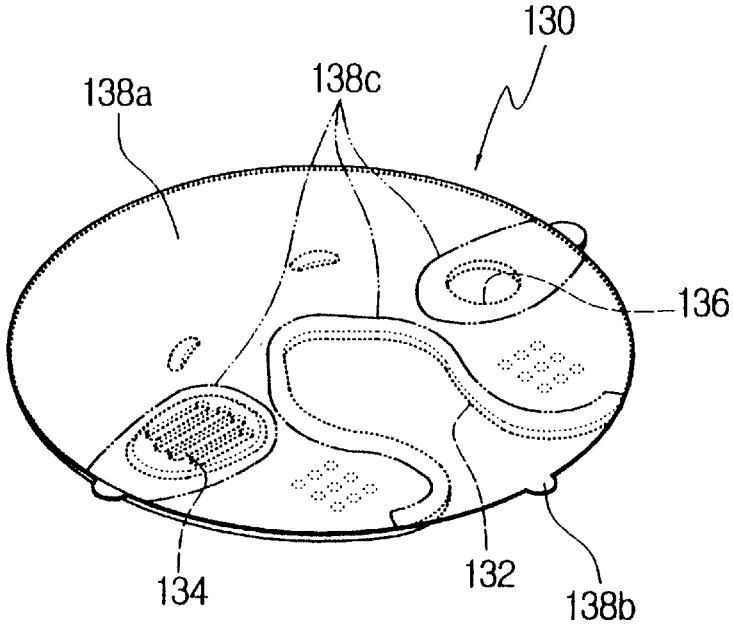

In the meanwhile, as shown in FIGS. 4*e* and 4*f*, the container cover 130 is configured in a manner such that a protective tape 138*a* is removably attached to the upper surface of the container cover 130. The protective tape 138*a* serves to prevent foreign substances from directly adhering to the upper surface of the container cover 130. Further, as shown in FIGS. 4*g* and 4*h*, the protective tape 138*a* can be formed to have a contour which is similar to that of the beverage discharging opening 132 so that it can close only the beverage discharging opening 132. Also, the protective tape 138*a* can be modified to have a variety of shapes. Also, as shown in FIG. 4*i*, the protective tape 138*a* can be removably attached to the entire upper surface of the container cover 130, and dotted cut lines 138*c* are formed on the protective tape 138*a* selectively around the beverage discharging opening 132, the straw insertion hole 136 and the plurality of filtering holes 134, thereby enabling the user to selectively and partially remove the protective tape 138*a* as occasion demands and use the correspondingly exposed opening or hole.

Moreover, a removal tab portion 138*b* is provided in an edge portion of each piece of the protective tape 138*a*, which is independently removed from the entire protective tape 138*a*, thereby allowing a protective tape removing operation to be smoothly performed upon drinking the beverage.

Figure 4J:
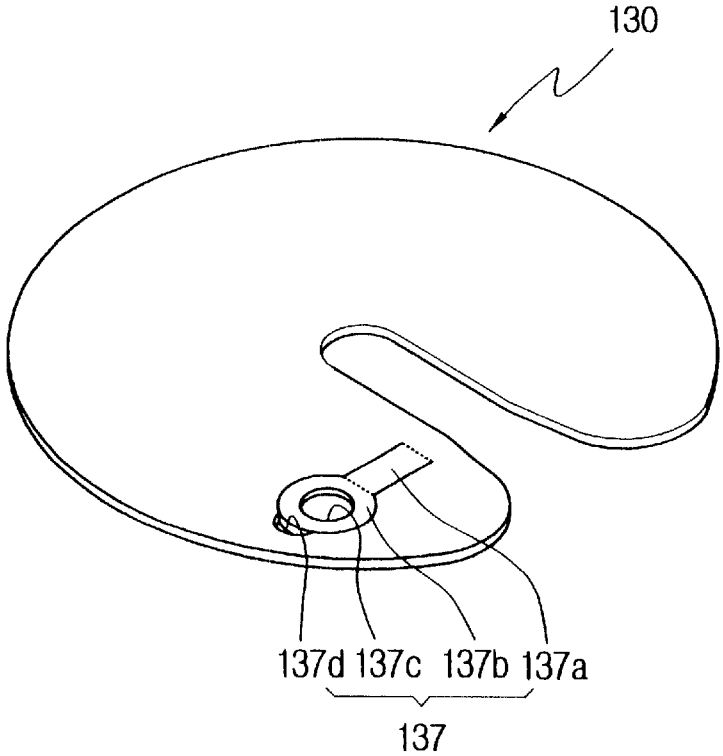
Figure 4K:
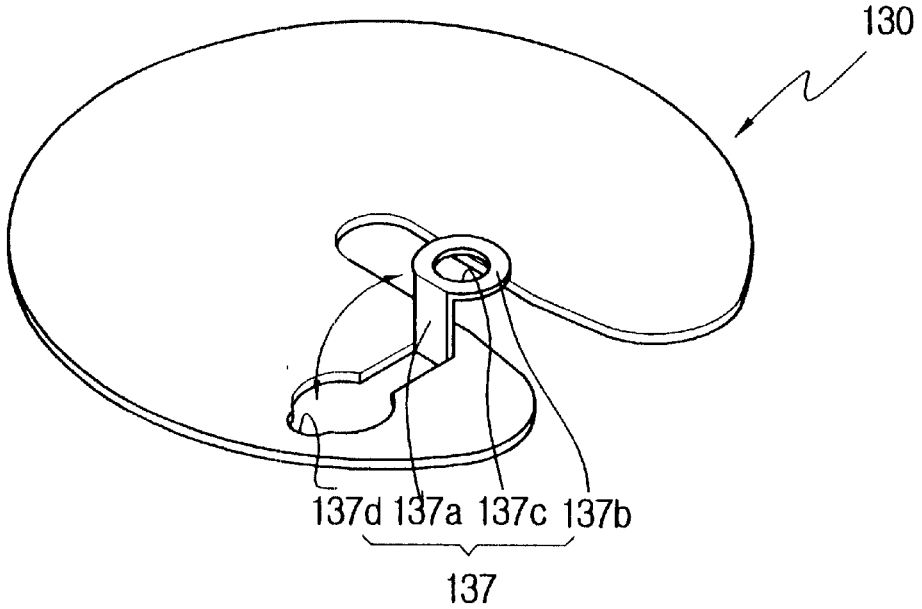
Figure 4L:
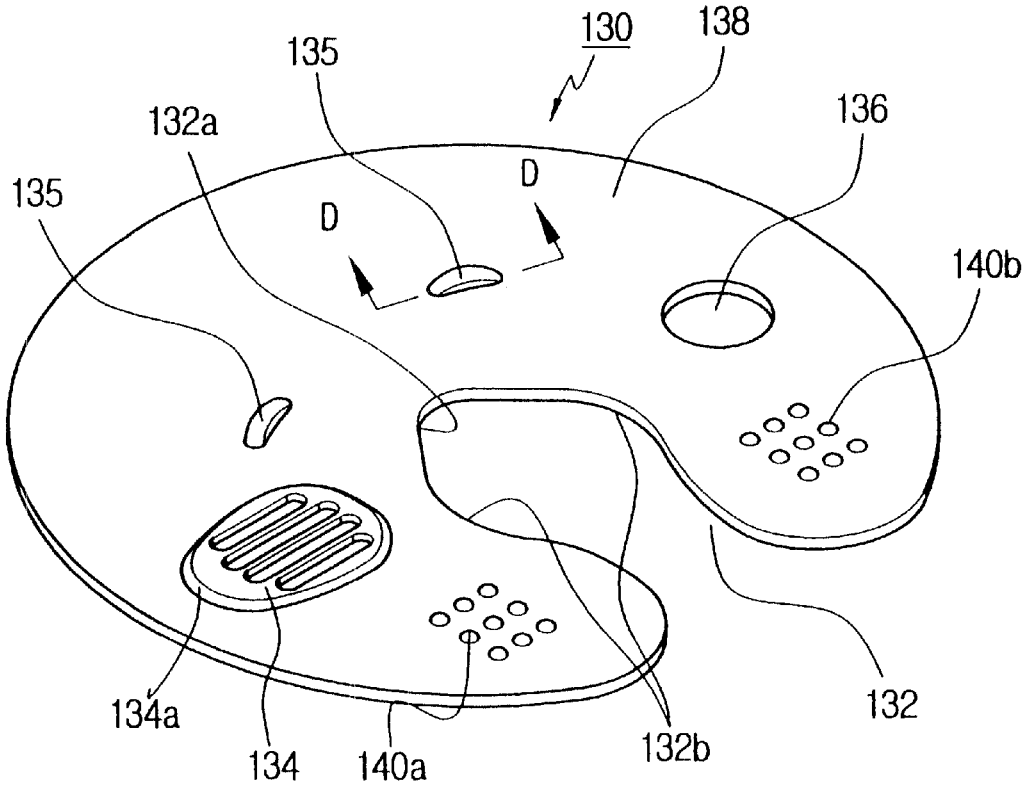

In the mean time, referring to FIGS. 4*j* and 4*k*, there are shown perspective views illustrating another straw insertion structure according to the present invention. As shown in FIGS. 4*j* and 4*k*, in the vicinity of the beverage discharging opening 132 of the container cover 130, a straw supporting member 137 is formed by the fact that a portion of the container cover 130 is cut. The straw supporting member 137 is configured in a manner such that it can be folded at a predetermined angle to be positioned above the beverage discharging opening 132.

The straw supporting member 137 comprises a supporting part 137*a* which has substantially a rectangular configuration and a straw insertion part 137*b* which has substantially an annular ring-shaped configuration. The supporting part 137*a* has one end which adjoins the beverage discharging opening 132 of the container cover 130. The one end of the supporting part 137*a* is integrally formed with the body of the container cover 130 in a manner such that it can be folded from a plane of the container cover 130 along a dotted cut line at a predetermined angle. The supporting part 137*a* has the other end which is formed as a free end. The straw insertion part 137*b* is integrally formed with the other end of the supporting part 137*a* in a manner such that it can be folded from a plane of the supporting part 137*a* along a dotted cut line at a predetermined angle. A straw insertion hole 137*c* is defined in a center portion of the straw insertion part 137*b* to have a predetermined diameter in a manner such that the straw can be inserted therethrough.

Also, a semi-circular groove 137*d* is defined at a portion of the container cover 130, which defines the straw supporting member 137 in such a manner that it faces the other end of the straw insertion part 137*b*, thereby to allow the straw supporting member 137 to be easily separated from the body of the container cover 130.

In a state wherein the straw supporting member 137 is configured as shown in FIG. 4*j*, if the user wishes to use the straw supporting member 137, as shown in FIG. 4*k*, a fingernail or the like is first inserted into the semi-circular groove 137*d*. Then, the supporting part 137*a* is folded at the predetermined angle and thereafter, the straw insertion part 137*b* is folded at the predetermined angle. Thus, in a state wherein the straw insertion part 137*b* is positioned above the beverage discharging opening 132, the straw is inserted through the straw insertion hole 137*c* to enable the user to drink the beverage using the straw. At this time, by altering the folding angles of the supporting part 137*a* and the straw insertion part 137*b* of the straw supporting member 137 to angles which are adequate for the user to drink the beverage, it is possible to easily drink the beverage accommodated in the beverage container 100, without experiencing any inconvenience.

On the other hand, referring to FIGS. 4*l* through 4*p*, means for preventing the fingernail of the user from being broken or damaged in the course of pulling upward the pull tab 122 for opening the discharging hole 124 of the beverage container 100, is provided to the container cover 130 which has the beverage discharging hole 132 and the plurality of protuberances 140, thereby enabling the discharging hole 124 to be easily opened. Two groups of protuberances 140*a* and 140*b* are formed on the container cover 130 leftward and rightward, respectively, of the beverage discharging opening 132 for rendering rotation of the container cover 130. In the case that the container cover 130 is mounted to the metal can serving as the beverage container, a pair of tab lifting projections 135 for slantingly lifting the pull tab 122 at a predetermined angle upon rotation of the container cover 130, are formed at positions which correspond to both sides of the pull tab 112 (see FIG. 4*o*).

Here, it should be noted that the pair of tab lifting projections 135 can be formed when forming the container cover 130 (that is, in a pressing process). As an example of this, it is preferred that the shape as shown in FIG. 4*m* or the shape as shown in FIG. 4*n* be used.

Figure 4M:
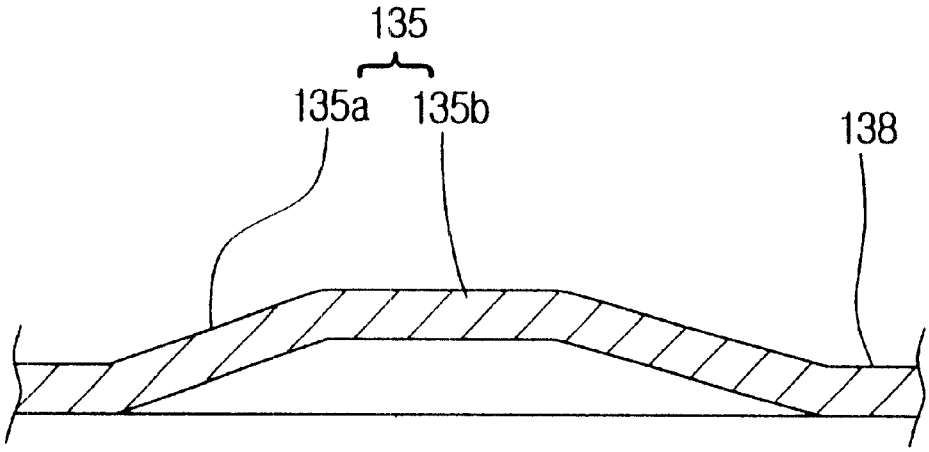

That is to say, referring to FIG. 4*m*, when the container cover 130 is rotated, both sides of each tab lifting projection 135 are formed with a pair of upward inclined portions 135*a* in a manner such that the pull tab 122 is easily lifted by the pair of upward inclined portions 135*a*. Also, a middle portion of each tab lifting projection 135 is formed in the shape of a tab supporting portion 135*b* which is flatly formed between the pair of upward inclined portions 135*a* in a manner such that the tab 122 is maintained in a lifted state.

Figure 4N:
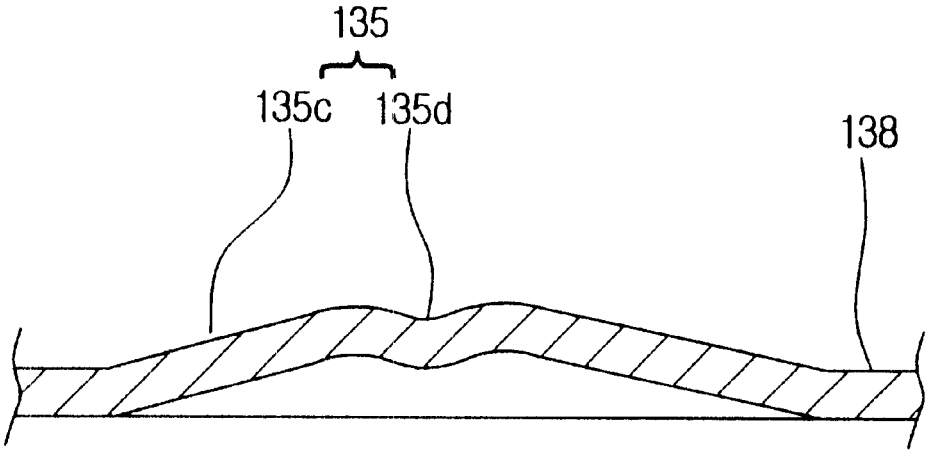
Figure 4O:
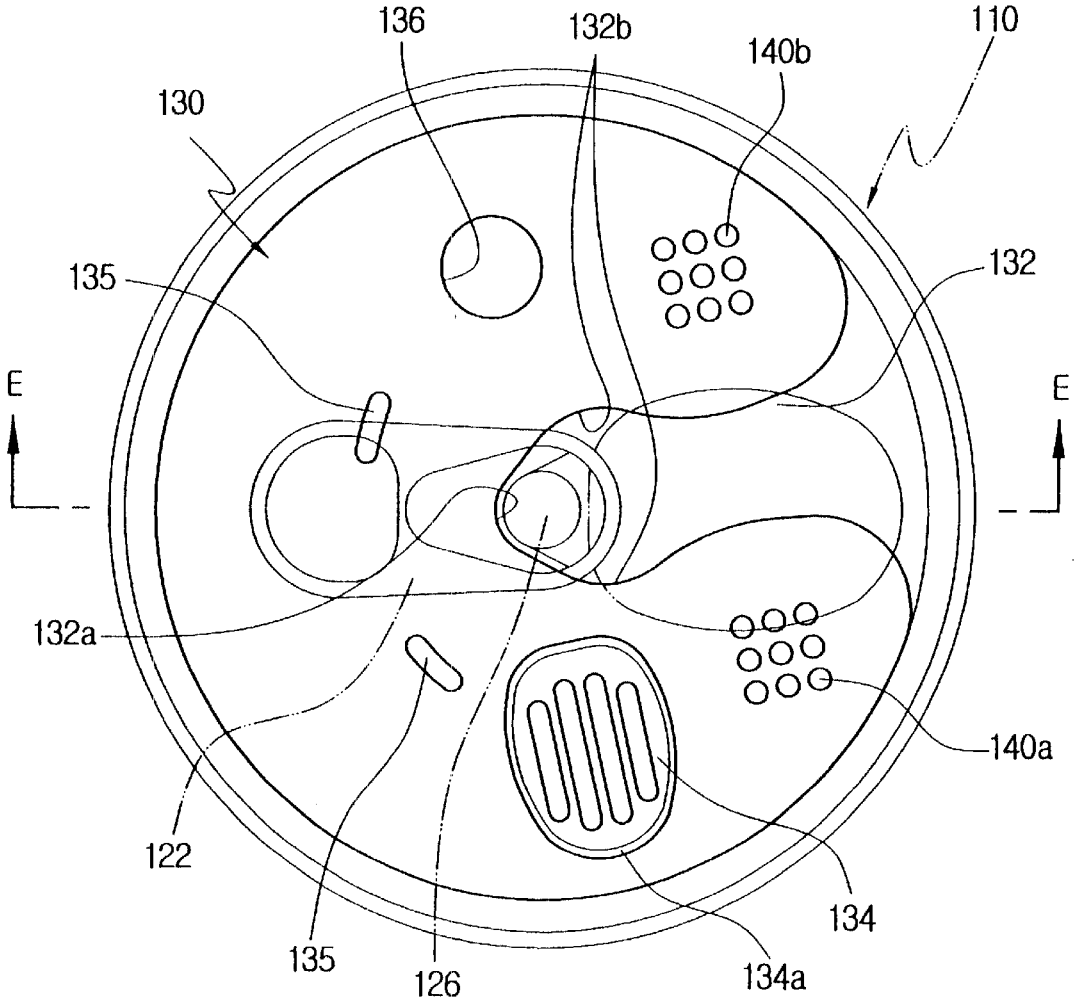
Figure 4P:
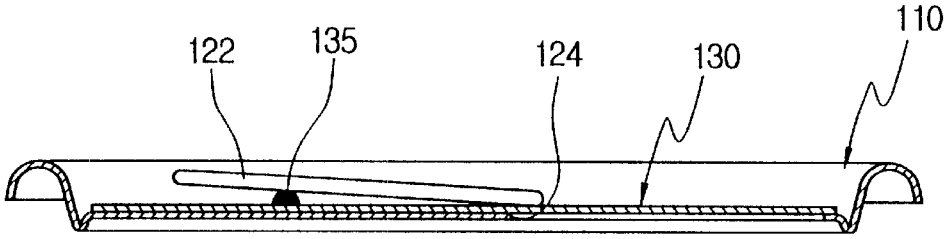

Referring to FIG. 4*n*, both sides of each tab lifting projection 135 are formed with a pair of upward inclined portions 135*c*. Also, a middle portion of each tab lifting projection 135 is formed in the shape of a tab supporting portion 135*d* which is depressed downward between the pair of upward inclined portions 135*c* in a manner such that the pull tab 122 is maintained in a lifted state.

Accordingly, by adopting the pair of tab lifting projections 135 constructed as just mentioned above, as shown in FIG. 4*o*, if rotating force is applied to two groups of protuberances 140*a* and/or 140*b* to rotate the container cover 130, as the upward inclined portion 135*a* or 135*c* of the tab lifting projection 135 is moved below the pull tab 122, the pull tab 122 is positioned on the tab supporting portion 135*b* or 135*d*. And, in this way, a manipulating space for pulling upward the pull tab 122 and thereby opening the discharging hole 124 is sufficiently secured.

Figure 4Q:
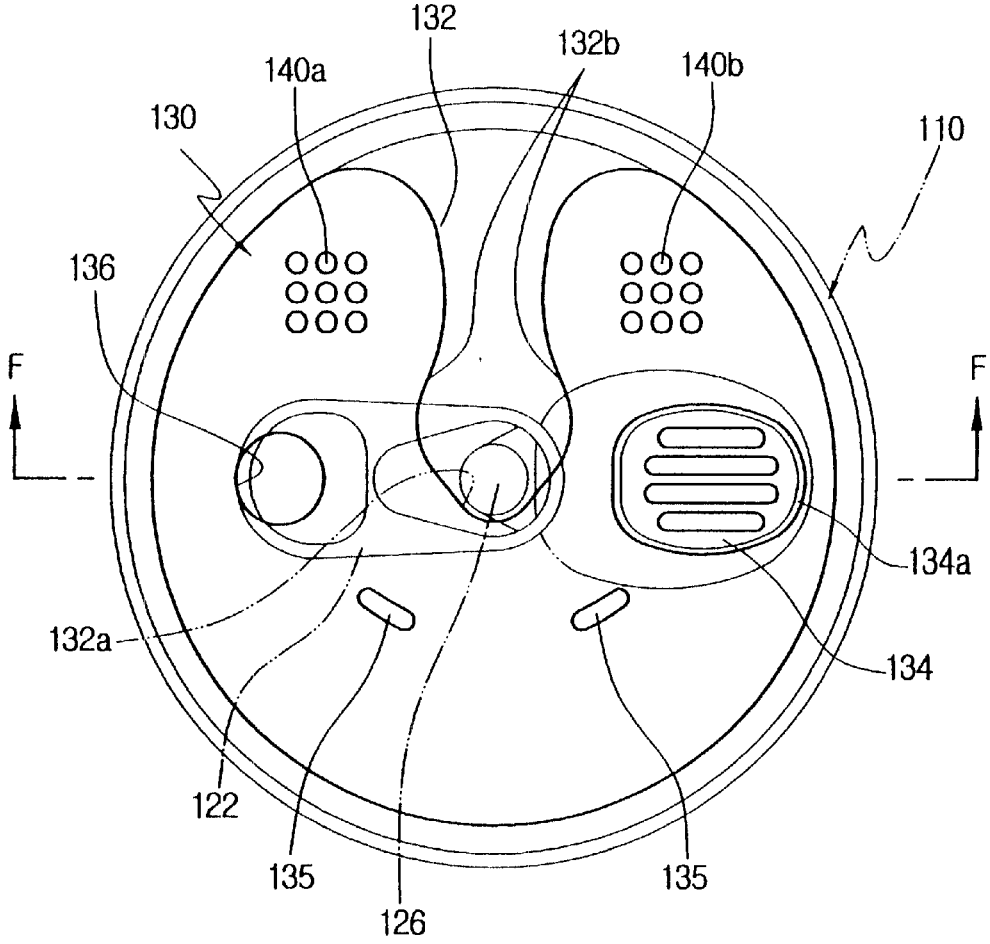
Figure 4R:
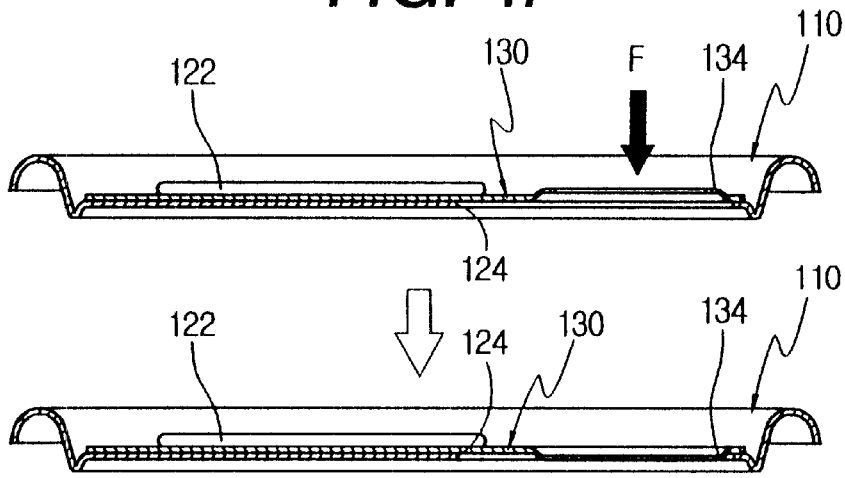

Also, according to the present invention, as shown in FIGS. 4*q* through 4*r*, the plurality of filtering holes 134 are defined upon forming the container cover 130 in a manner such that the filtering part which includes the plurality of filtering holes 134 projects upward from the plane of the container cover 130 and a press line 134*a* is formed around the filtering part.

Consequently, in the configuration of the filtering part including the plurality of filtering holes 134, as can be readily seen from FIG. 4*r*, even in the case that the container cover 130 is rotated, a lower surface of the filtering part is not brought into direct contact with the upper surface of a body 110 of the beverage container 100. Also, in this configuration, in a state wherein the filtering part is aligned with the discharging hole 124 which is formed in the upper surface of the beverage container 100, by depressing downward the filtering part including the plurality of filtering holes 134, the filtering part is fitted into the discharging hole 124. Therefore, due to the fact that the lower surface of the filtering part is flushed with a lower end of the discharging hole 124, it is possible to drink the beverage in a state wherein solid matters are not caught therebetween.

In the meanwhile, a person skilled in the art will readily appreciate that a configuration and a size of the body of the container cover 130 according to the present invention can be changed, depending upon a type of a beverage container which is used, without departing from the technical spirit of the present invention. Likewise, the present invention must not be understood to be limited with regard to a thickness, a material and a color of the body of the container cover 130. Instead, the contours and the numbers of the beverage discharging opening 132, the plurality of filtering holes 134, the inner diameter of the straw insertion hole 136, and so forth can be diversely changed.

Figure 5:
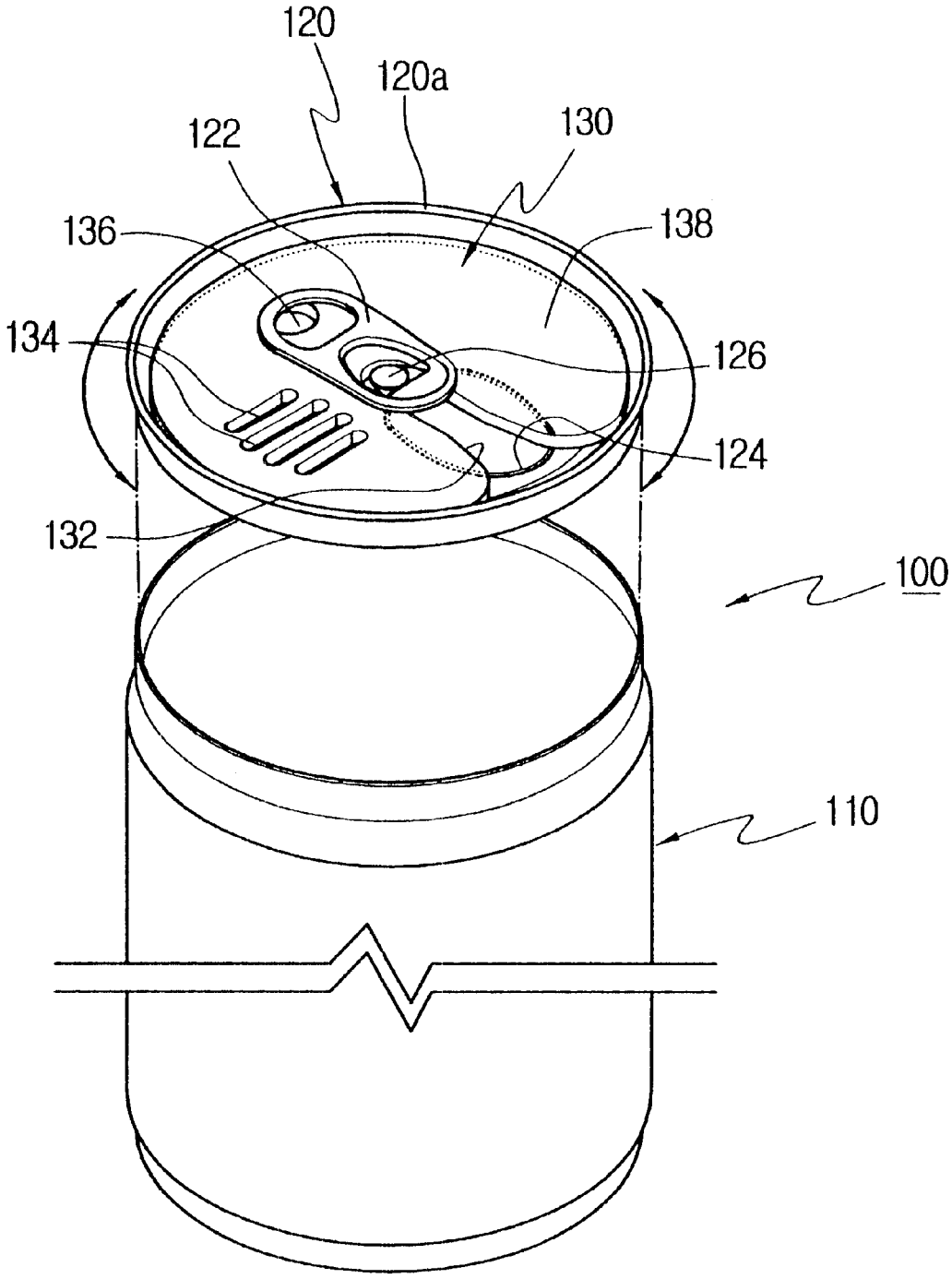
FIG. 5 is an exploded perspective view illustrating a beverage container in which the container cover according to the present invention is coupled to a container end.

FIG. 5 is an exploded perspective view illustrating the beverage container in which the container cover according to the present invention is coupled to the container end.

As shown in FIG. 5, the beverage container 100 according to the present invention has a construction wherein the container cover 130 is installed on the upper surface of the container end 120 which is coupled to an upper end of the body 110 of the beverage container 100. The container cover 130 is rotatably coupled between the upper surface of the container end 120 and the pull tab 122 in the course of forming the container end 120 of the beverage container 100.

Figure 6:
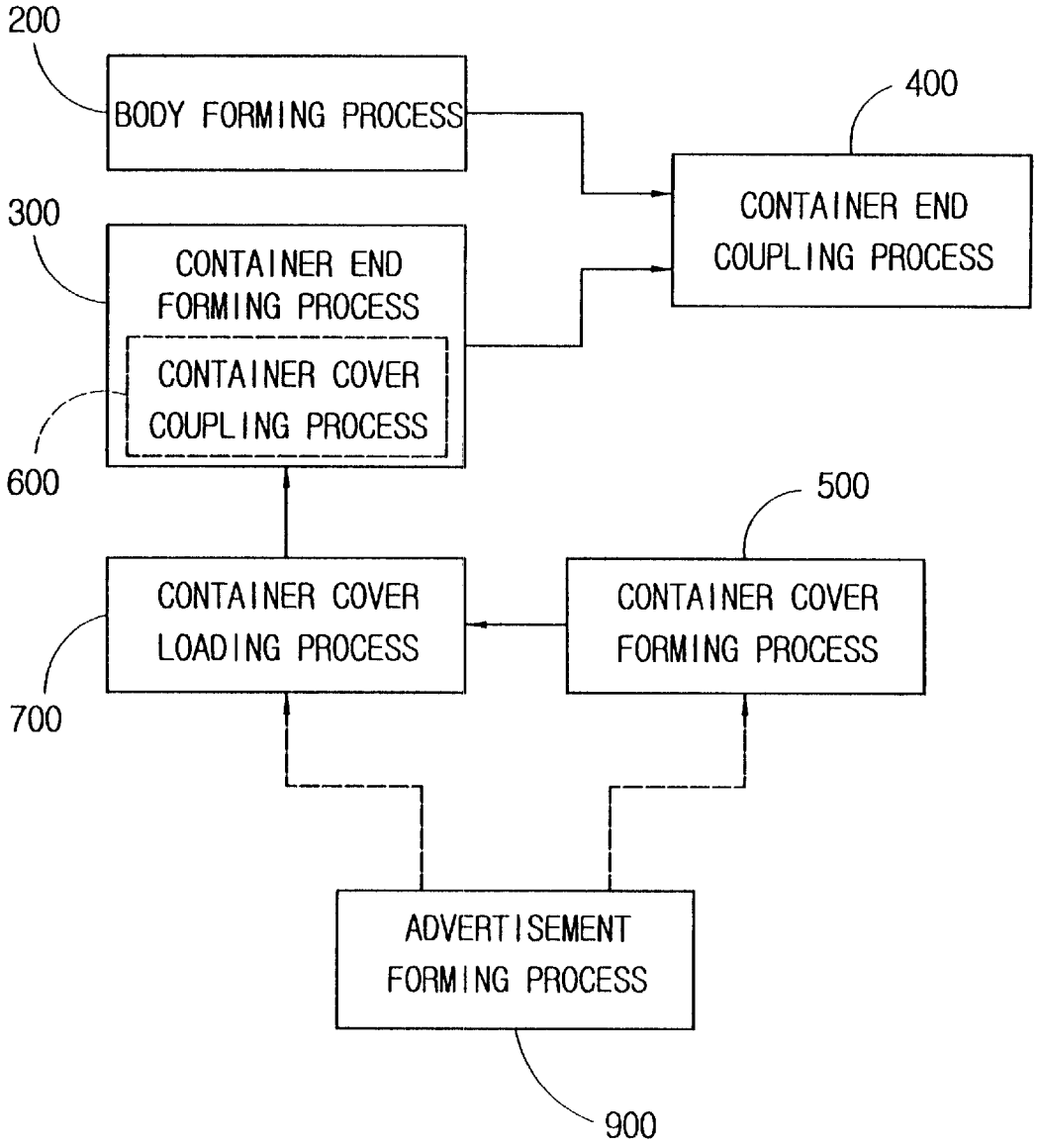
FIG. 6 is a block diagram illustrating an entire procedure of a method for mounting a container cover which is mountable to a beverage container, in accordance with the embodiment of the present invention.
Figure 7:
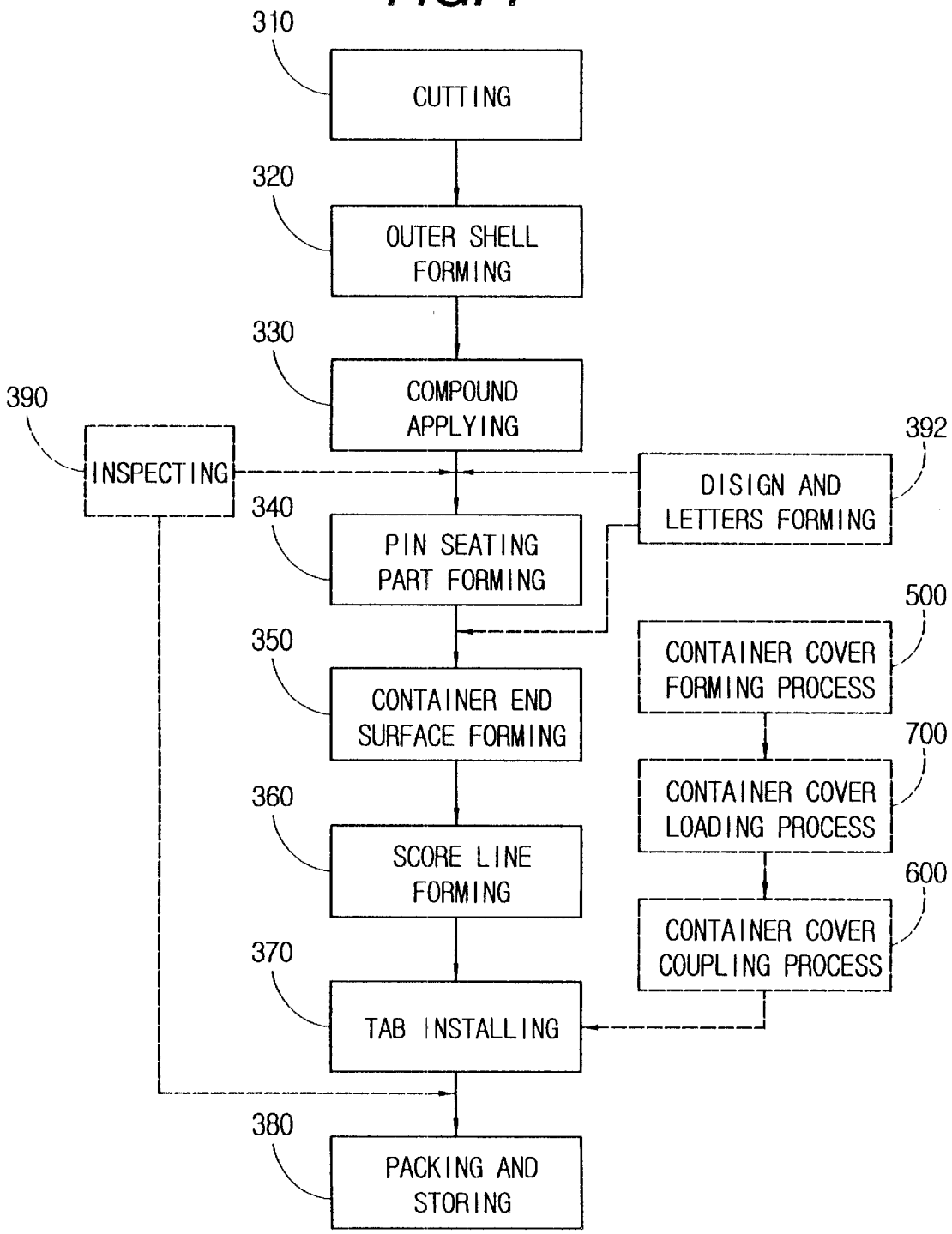
FIG. 7 is a block diagram illustrating detailed processes of the method for mounting a container cover which is mountable to a beverage container, in accordance with the embodiment of the present invention.
Figure 8A:
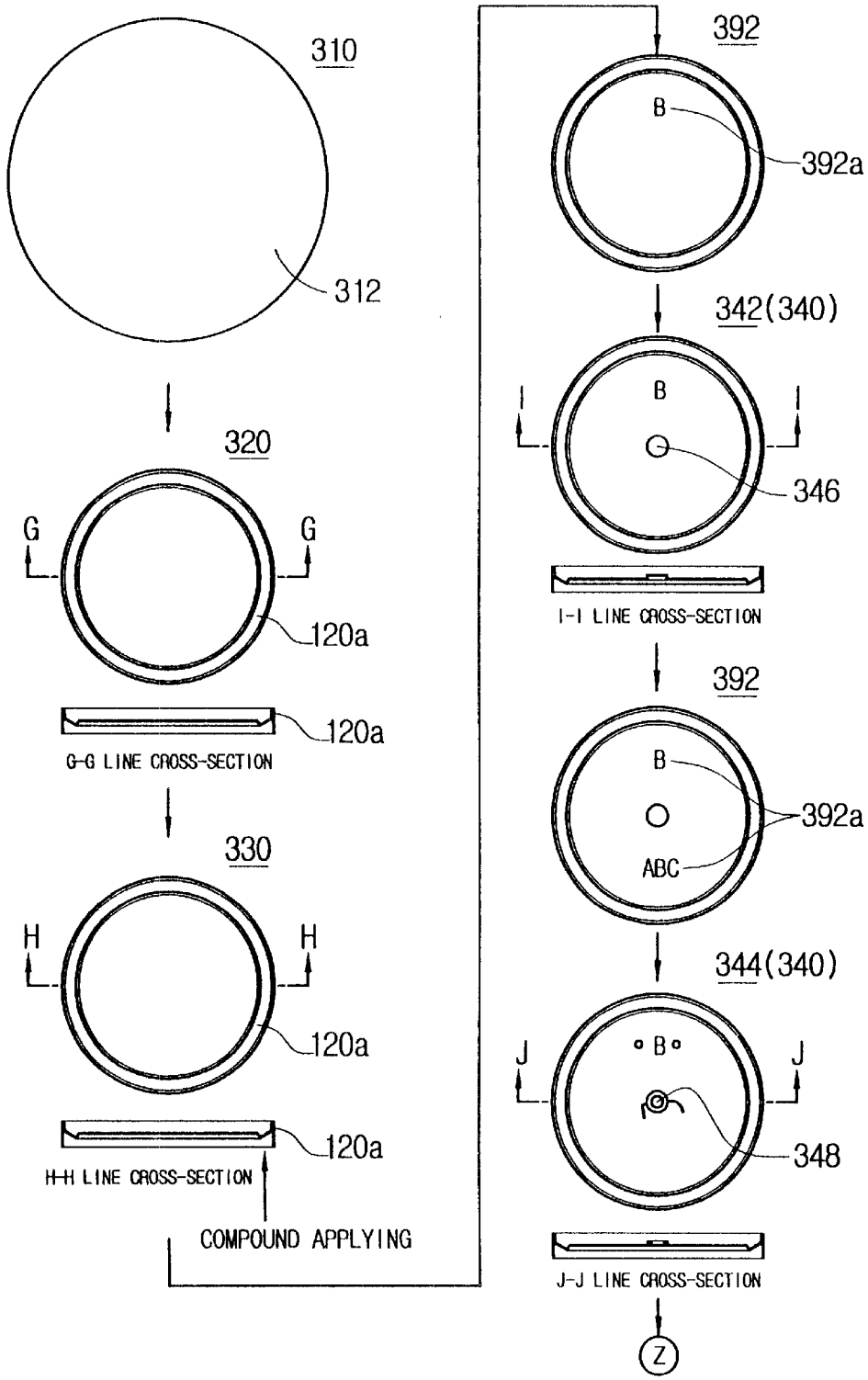
FIGS. 8*a* and 8*b* are explanatory views used for explaining the method for mounting a container cover which is mountable to a beverage container, in accordance with the embodiment of the present invention.
Figure 8B:
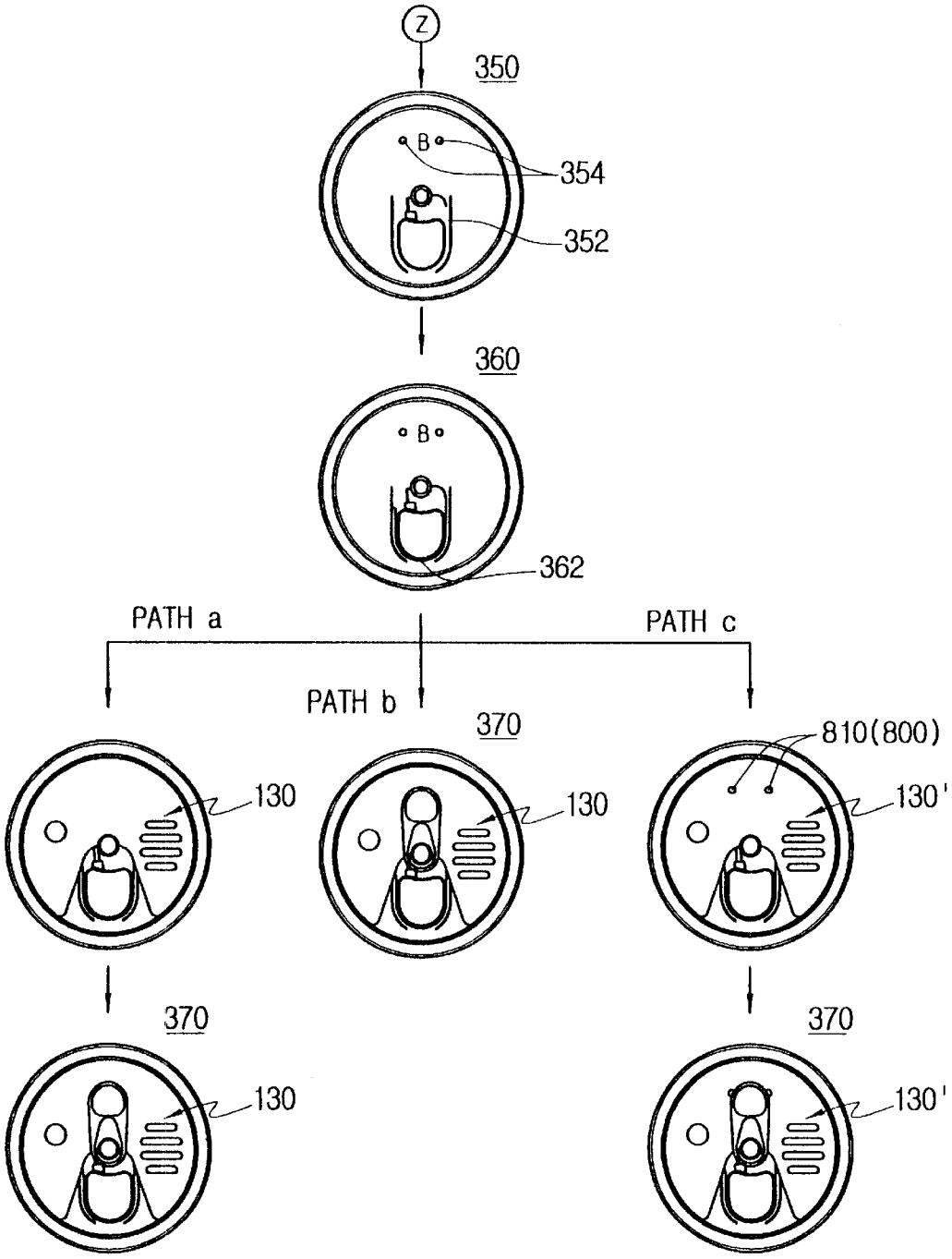

FIG. 6 is a block diagram illustrating an entire procedure of a method for mounting a container cover which is mountable to a beverage container, in accordance with the embodiment of the present invention; FIG. 7 is a block diagram illustrating detailed processes of the method for mounting a container cover which is mountable to a beverage container, in accordance with the embodiment of the present invention; and FIGS. 8*a* and 8*b* are explanatory views used for explaining the method for mounting a container cover which is mountable to a beverage container, in accordance with the embodiment of the present invention. More particularly, FIGS. 8*a* and 8*b* are views which are connected with each other and schematically illustrate the processes as shown in FIG. 7.

As shown in FIGS. 6 and 7, a method for mounting a container cover which is mountable to a beverage container in accordance with the embodiment of the present invention comprises a body forming process 200, a container end forming process 300, a container end coupling process 400, a container cover forming process 500 and a container cover coupling process 600.

The body forming process 200 is a process for forming the body 110 of the beverage container 100, in which the beverage is to be accommodated. The container end forming process 300 is a process for forming the container end 120 which is to be coupled to the upper end of the body 110 formed by the body forming process 200 and to which the pull tab 122 for opening the discharging part and thereby defining the discharging hole 124 is coupled. As described above, the discharging hole 124 allows the beverage to be discharged out of the beverage container 100 therethrough.

The container cover forming process 500 is a process for forming the container cover 130 which is composed of the body of substantially the disc-shaped configuration and is mounted to the upper surface of the container end 120, with the body selectively formed with the beverage discharging opening 132, the plurality of filtering holes 134 and the straw insertion hole 136. The container cover coupling process 600 is a process for rotatably coupling the container cover 130 formed in the container cover forming process 500, between the upper surface of the container end 120 and the pull tab 122.

The body forming process 200, the container end forming process 300 and the container cover forming process 500 are inconsecutive processes which may not be sequentially implemented. Therefore, the body 110 of the beverage container 100, the container end 120 and the container cover 130 are formed in their respective forming processes, depending upon process conditions such as a processing time, a space and the like. Thereafter, while they are kept in stock, they can be used in the container end coupling process 400 or in the container cover coupling process 600. The container cover coupling process 600 is performed while the container end forming process 300 is implemented.

Moreover, the container cover forming process 500 is implemented through a press work using a press. The method according to the present invention further comprises a container cover loading process 700 for loading the container cover 130 which is formed in such a way, using a loading device (not shown), and for supplying the container cover 130 onto the upper surface of the container end 120.

The method can further comprise an advertisement forming process 900 for forming the advertisement such as the design, letters, and so forth, on the upper surface of the container cover 130 while the container cover forming process 500 or the container cover loading process 700 is implemented. The advertisement forming process 900 can be effected using a printing technique in which the design and letters are printed on the container cover 130, an affixing technique in which an advertisement is affixed onto the container cover 130 or a forming technique in which the design and the letters are integrally formed on the container cover 130. However, the advertisement forming process 900 is not limited to the above-described techniques, and instead, can use a diversity of other techniques which are well known in the art. Also, the advertisement forming process 900 must not be understood as being limitedly implemented only while implementing the container cover forming process 500 or the container cover loading process 700. Instead, the advertisement forming process 900 can be implemented under other processes without limitation.

The loading device can comprise a conveyor system, a feeding robot or the like.

On the other hand, describing the container end forming process 300 in detail with reference to FIG. 7, the container end forming process 300 comprises a cutting step 310 for circularly cutting a thin metal plate, (preferably, a metal plate which is wound in the form of a coil is mounted to a facility such as a coiler to enable a continuous cutting operation), which is coated with aluminum thereby to form a circular plate 312, an outer shell forming step 320 for forming an outer shell 120*a* of the container end 120 by bending upward an edge portion of the circular plate 312 which is cut in the cutting step 310, a compound applying step 330 for applying compound at a portion where the outer shell 120*a* which is formed in the outer shell forming step 320 is coupled to the upper end of the body 110 of the beverage container 100, a first step 342 for forming a protrusion 346 having a predetermined size, on a center portion of the circular plate 312 as shown in FIG. 8*a*, and a second step 344 for forming a pin seating part 348 on which a central pin 126 for fastening the pull tab 122 is seated, by depressing downward a center portion of the protrusion 346 which is formed in such a way. The first step 342 and the second step 344 cooperatively constitute a pin seating part forming step 340.

The container end forming process 300 further comprises a container end surface forming step 350 for forming a schematic entire contour of a container end surface on the circular plate 312, which includes a pair of tab fixing projections 354 for fixedly maintaining a position of the pull tab 122 and the discharging part 352 to be formed with the discharging hole 124, a score line forming step 360 for forming a score line 362 in a manner such that the score line 362 corresponds to the contour of the discharging hole 124 in a manner such that the discharging hole 124 through which the beverage is discharged out of the beverage container 100 is formed as the discharging part 352 which is defined in the container end surface forming step 350 is opened by the depressing force of the pull tab 122, and a tab installing step 370 for loading and fastening the pull tab 122 on the pin seating part 348 which is formed in the pin seating part forming step 340.

In the meanwhile, after implementing the compound applying step 330 and the tab installing step 370, as shown in FIG. 7, an inspecting step 390 for inspecting forming conditions at the respective steps and thereby for checking inferiority can be implemented. It is not necessary that this inspecting step 390 be limitedly implemented only after the compound applying step 330 and the tab installing step 370.

Instead, the inspecting step 390 can be implemented before or after the various processes and steps, as occasion demands.

Also, as shown in FIGS. 7, 8*a* and 8*b*, after the compound applying step 330 and the pin seating part forming step 340 are implemented, a design and letter forming step 392 for indicating manufacturing details 392*a* or forming advertising letters, design, and so forth, can be implemented.

In implementing the above-described container cover coupling process 600, before the pull tab 122 is loaded and coupled to the container end 120, the container cover 130 can be loaded on the container end 120 (see the path 'a' of FIG. 8*b*), or the pull tab 122 and the container cover 130 are simultaneously loaded on the container end 120. Thereupon, as the pull tab 122 is installed on the container end 120 by the central pin 126, the container cover 130 is supported along with the pull tab 122 by the central pin 126 (see the path 'b' of FIG. 8*b*). For example, as shown in FIG. 7, in implementing the tab installing step 370, the container cover 130 is simultaneously loaded and installed along with the pull tab 122 which is to be coupled to the container end 120 by the central pin 126.

Also, fluctuation preventing means 800 are formed on the container end 120 or on the container cover 130 in a manner such that the container cover 130 is fixedly maintained in place without being fluctuated while the container cover 130 is loaded on the upper surface of the container end 120 and installed between the upper surface of the container end 120 and the pull tab 122, and in a manner such that the tab fastening operation is smoothly performed upon implementing the tab installing step 370.

For example, as in the container cover 130' illustrated in FIG. 8*b* (see the path 'c'), the fluctuation preventing means 800 comprises a pair of engaging grooves 810 which are formed in the container cover 130' (see FIG. 8*b*) in a manner such that the pair of tab fixing projections 354 which are projectedly formed on the upper surface of the container end 120 in the container end surface forming step 350 for enabling the pull tab 122 installed on the container end surface in the tab installing step 370 to be fastened without experiencing fluctuation, are engaged into the pair of engaging grooves 810, respectively. In the case that the pair of engaging grooves 810 are formed in the container cover 130' as described above, the pair of engaging grooves 810 can be simultaneously formed upon implementing a press work in the container cover forming process 500.

In other words, because the pair of tab fixing projections 354 are engaged into the pair of engaging grooves 810, respectively, of the container cover 130', when installing the pull tab 122, the container cover 130 can be fixedly maintained without experiencing fluctuation. And, in a state wherein the container cover 130 is fixed, if the user pulls upward the pull tab 122 in order to drink the beverage accommodated in the beverage container 100, as a distance between the pull tab 122 and the container end surface is lengthened, the container cover 130 is ready to be rotated.

In the container end forming process 300, if the tab installing step 370 by which the pull tab 122 is installed, is completed, a packing and storing process 380 for packing and storing the container end 120 in a proper unit is effected.

In the meanwhile, the method for mounting a container cover mountable to a beverage container is not limited to the method according to the above-described embodiment, and instead, can be variously modified without departing from the technical spirit of the present invention. Also, while it is explained in the above embodiment that the cylindrical metal container is used, the present invention must not be understood to be limited to this construction. Rather, the present invention can be applied to containers which have a variety of materials and a diversity of configurations. In this regard, it is preferred that materials for the container and the container cover be the same with each other for promoting recycling. For example, if the beverage container is made of aluminum, the container cover can also be made of aluminum for facilitating material recycling. In accordance with another embodiment of the present invention, the beverage container and the container cover can be made of paper.

Hereinafter, a method for mounting a container cover mountable to a beverage container, in accordance with another embodiment of the present invention will be described with reference to the attached drawings.

Figure 9A:
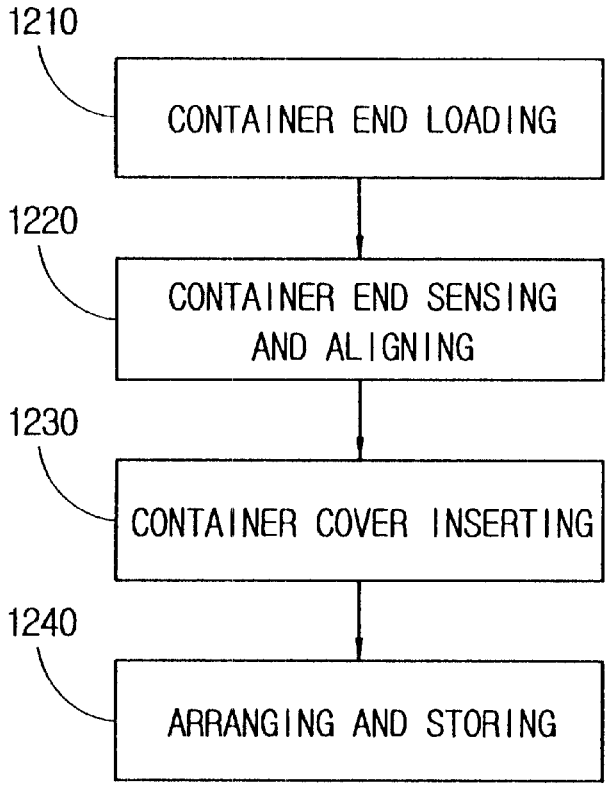
FIG. 9*a* is a block diagram illustrating an entire procedure of a method for mounting a container cover which is mountable to a beverage container, in accordance with another embodiment of the present invention.
Figure 9B:
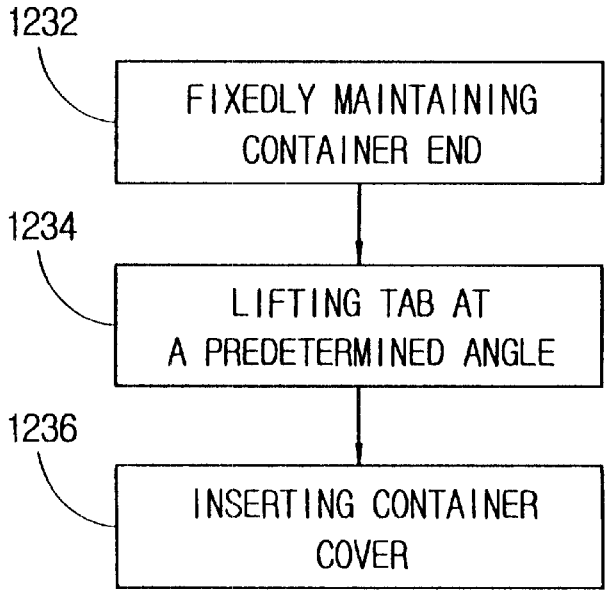
FIG. 9*b* is a block diagram illustrating detailed processes of the method for mounting a container cover which is mountable to a beverage container, in accordance with the embodiment of the present invention, as shown in FIG. 9*a;*

FIG. 9*a* is a block diagram illustrating an entire procedure of a method for mounting a container cover which is mountable to a beverage container, in accordance with another embodiment of the present invention; FIG. 9*b* is a block diagram illustrating detailed processes of the method for mounting a container cover which is mountable to a beverage container, in accordance with the embodiment of the present invention, as shown in FIG. 9*a*; and FIG. 10 is a schematic view illustrating a course in which the container cover is mounted to the container end, while implementing the method for mounting a container cover which is mountable to a beverage container, in accordance with the embodiment of the present invention, as shown in FIG. 9*a*.

In the method for mounting a container cover mountable to a beverage container in accordance with another embodiment of the present invention, as shown in FIG. 9*a*, the container end 120 is formed by the preset container end forming process, and the container cover 130 is formed by the container cover forming process, for example, the press working process. At this time, the container cover 130 comprises the body of substantially the disc-shaped configuration. The container cover 130 has the beverage discharging opening 132, the plurality of filtering holes 134 and the straw insertion hole 136 which can be selectively formed in the body. The beverage discharging opening 132 is formed in such a manner that it is communicated with the discharging hole 124 which is formed by an opening action of the pull tab 122 mounted to the container end 120 which is coupled to the upper end of the body 110 of the beverage container 100, thereby allowing the beverage accommodated in the body 110 of the beverage container 100 to be discharged out of the beverage container 100. The plurality of filtering holes 134 are formed in a manner such that solid matters existing in the beverage container 100 can be filtered thereby. The straw insertion hole 136 is formed to have the predetermined diameter in a manner such that the straw can be inserted therethrough. The method in accordance with this another embodiment of the present invention comprises a container end loading step 1210 for loading the container end 120 and moving the container end 120 in a predetermined direction; a container end sensing and aligning step 1220 for sensing and aligning in a predetermined orientation the container end 120 which is moved by the container end loading step 1210; and a container cover inserting step 1230 for inserting the container cover 130 between the upper surface of the container end 120 which is moved in an aligned state by the container end sensing and aligning step 1220 and the pull tab 122.

Figure 10:
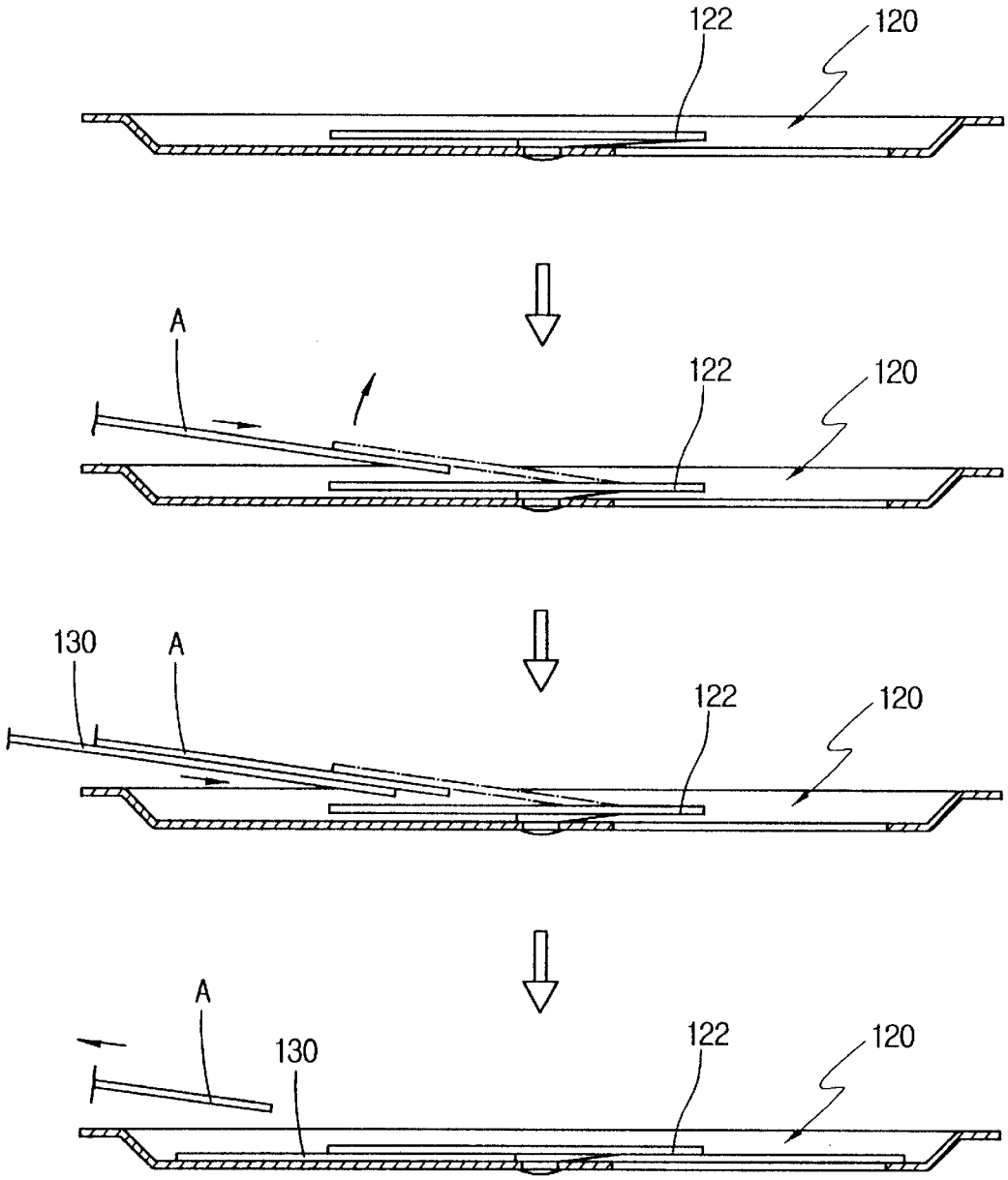
FIG. 10 is a schematic view illustrating a course in which the container cover is mounted to a container end, while implementing the method for mounting a container cover which is mountable to a beverage container, in accordance with the embodiment of the present invention, as shown in FIG. 9*a;*

As shown in FIGS. 9*b* and 10, the container cover inserting step 1230 comprises a first sub-step 1232 of fixedly maintaining the container end 120 which is moved, thereby to prevent the container end 120 from fluctuating; a second sub-step 1234 of slantingly lifting the pull tab 122 at a predetermined angle, which is coupled to the upper end of the container end 120 which is fixedly maintained by the first sub-step 1232; and a third sub-step 1236 of inserting the container cover 130 between the pull tab 122 which is lifted by the second sub-step 1234 and the upper surface of the container end 120.

The second sub-step 1234 is, as shown in FIG. 10, implemented using a proper tool which is inserted between the upper surface of the container end 120 and the pull tab 122 to lift the pull tab 122, such as a jig A. Also, the container cover inserting step 1230 further comprises the sub-step of returning the jig A which is inserted in the second sub-step 1234 to its original position after the container cover 130 is inserted between the container end 120 and the pull tab 122 in the third sub-step 1236. If the jig A is returned it its original position, as the pull tab 122 is also returned to its original position by its own elasticity, the mounting of the container cover 130 between the container end 120 and the pull tab 122 is completed.

The container end sensing and aligning step 1220 serves as a step for sensing and aligning the container end 120 in the predetermined orientation and then feeding the container end 120 to the next step, to ensure the fact that the container cover 130 is reliably inserted between the container end 120 and the pull tab 122 in the second and third sub-steps 1234 and 1236 of the container cover inserting step 1230. Namely, by the container end sensing and aligning step 1220, is because the pull tab 122 which is coupled to the upper surface of the container end 120, is aligned in the same predetermined direction, the second and third sub-steps 1234 and 1236 can be rapidly implemented using the single tool or the jig A, and it is not necessary to additionally adjust a direction of the tool or the jig A.

Moreover, as shown in FIG. 9*a*, the method for mounting the container cover according to the present invention, can further include an arranging and storing step 1240 for arranging and storing in a predetermined pattern container ends 120 each of which has the container cover 130 inserted between the pull tab 122 and itself by the container cover inserting step 1230.

On the other hand, as in the above-described method according to the present invention, if the container cover 130 is mounted to the container end 120, by implementing the step of mounting the container end 120 to the body 110 of the beverage container 100 into which the beverage is accommodated, the manufacturing of the beverage container 100 is completed.

Figure 11A:
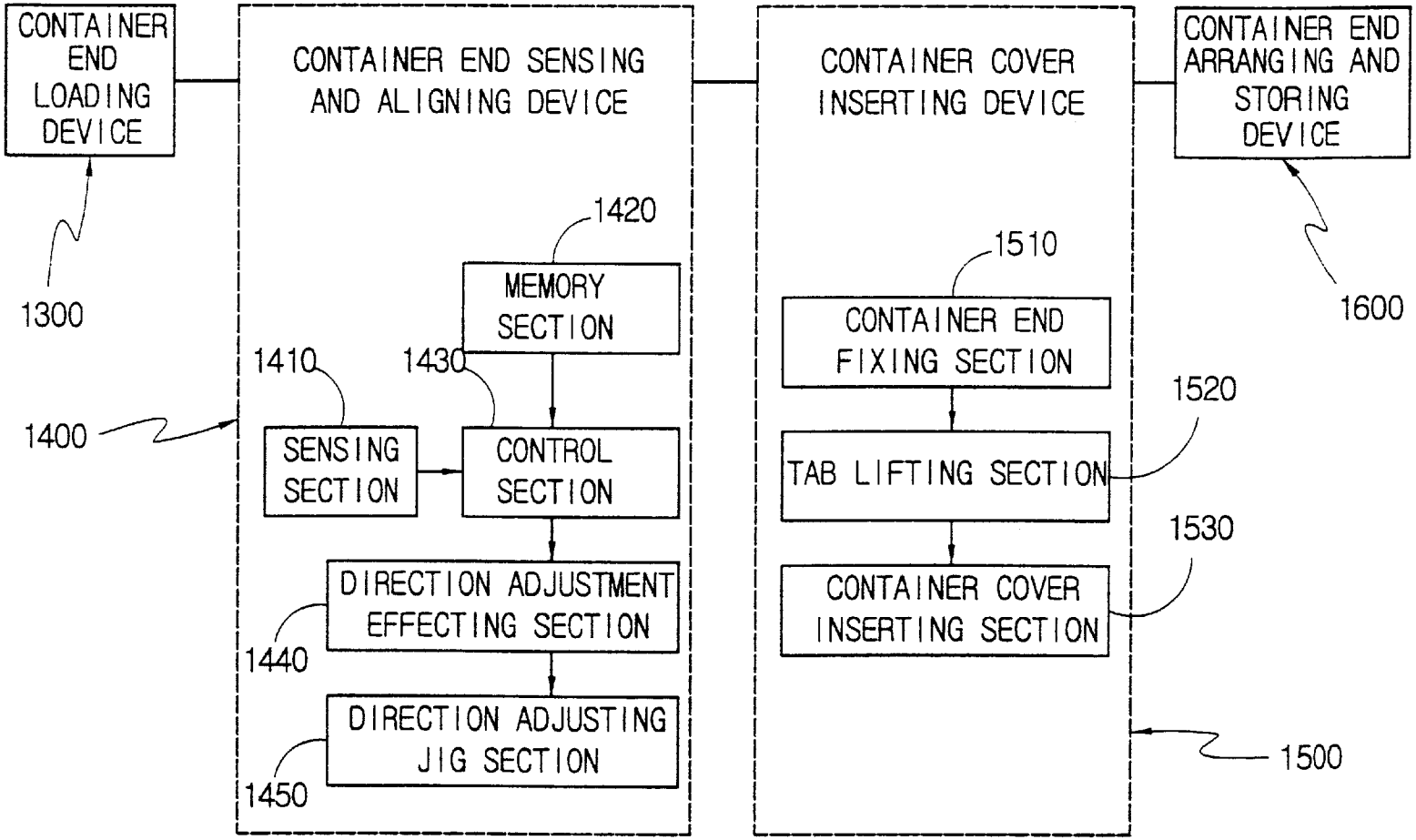
FIG. 11*a* is a block diagram illustrating an apparatus for mounting a container cover which is mountable to a beverage container, in accordance with still another embodiment of the present invention.
Figure 11B:
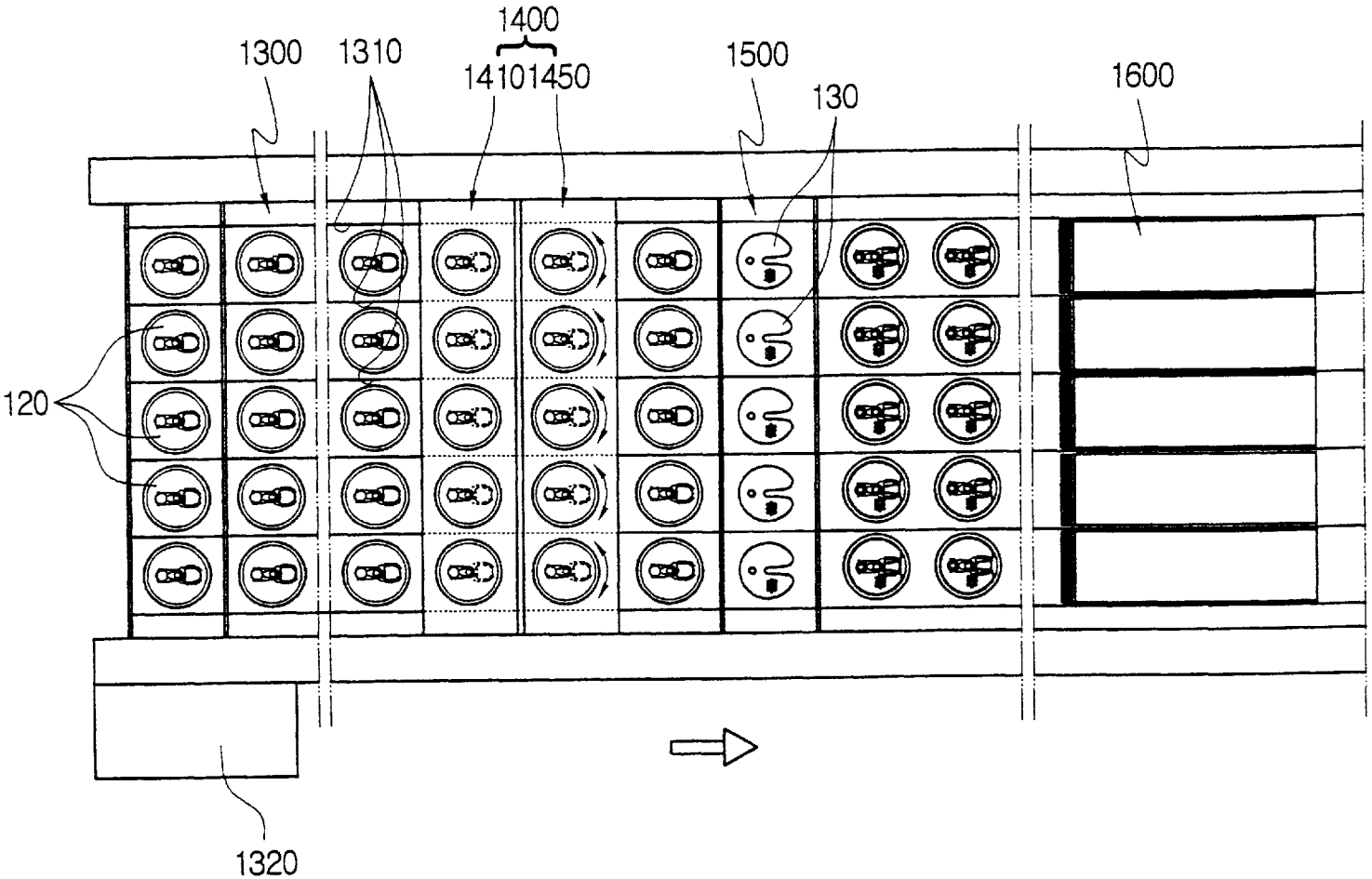
FIG. 11*b* is a schematic plan view illustrating the apparatus for mounting a container cover which is mountable to a beverage container, according to the embodiment of the present invention, as shown in FIG. 11*a*.

FIG. 11*a* is a block diagram illustrating an apparatus for mounting a container cover which is mountable to a beverage container, in accordance with still another embodiment of the present invention; and FIG. 11*b* is a schematic plan view illustrating the apparatus for mounting a container cover which is mountable to a beverage container, according to the embodiment of the present invention, as shown in FIG. 11*a*.

As shown in FIGS. 11*a* and 11*b*, an apparatus for mounting a container cover which is mountable to a beverage container, in accordance with the embodiment of the present invention, functions to mount the container cover 130 to the upper surface of the container end 120. At this time, the container cover 130 comprises the body of substantially the disc-shaped configuration. The container cover 130 has the beverage discharging opening 132, the plurality of filtering holes 134 and the straw insertion hole 136 which can be selectively formed in the body. The beverage discharging opening 132 is formed in such a manner that it is communicated with the discharging hole 124 which is formed by an opening action of the pull tab 122 mounted to the container end 120 which is coupled to the upper end of the body 110 of the beverage container 100, thereby allowing the beverage accommodated in the body 110 of the beverage container 100 to be discharged out of the beverage container 100. The plurality of filtering holes 134 are formed in a manner such that solid matters existing in the beverage container 100 can be filtered thereby. The straw insertion hole 136 is formed to have the predetermined diameter in a manner such that the straw can be inserted therethrough. The apparatus for mounting a container cover which is mountable to a beverage container, in accordance with the embodiment of the present invention, comprises a container end loading device 1300 for loading the container end 120 and moving the container end 120 in a predetermined direction; a container end sensing and aligning device 1400 for sensing and aligning in a predetermined orientation the container end 120 which is moved by the container end loading device 1300; a container cover inserting device 1500 for inserting the container cover 130 between the upper surface of the container end 120 which is moved in an aligned state by the container end sensing and aligning device 1400 and the pull tab 122; and a container end arranging and storing device 1600 for arranging and storing in a predetermined pattern container ends 120 each of which has the container cover 130 inserted between the pull tab 122 and itself by the container cover inserting device 1500.

As shown in FIG. 11*b*, the container end loading device 1300 comprises a conveyor system which is capable of loading and feeding the container end 120 when the container end 120 formed by the container end forming process is transferred therein. It is preferred that the conveyor system is configured in a manner such that a plurality of feeding columns 1310 each of which can feed a plurality of container ends 120, are arranged therein, in a state wherein they are spaced apart one from another by a predetermined distance. The drawing reference numeral 1320 represents a driving device for driving the container end loading device 1300.

The container end sensing and aligning device 1400 comprises a sensing section 1410 for sensing a configuration of the container end 120 which is moved along its path; a memory section 1420 for storing image data signals which correspond to the plurality of container ends 120, respectively; a control section 1430 for receiving an image signal of the container end 120, which is sensed by the sensing section 1410, comparing the image signal with an image data signal of a corresponding container end 120, which is stored in the memory section 1420, and creating a direction adjusting signal when the image signal sensed by the sensing section 1410 is different from the image data signal stored in the memory section 1420, thereby to enable an image signal which is the same as the image data signal to be sensed by the sensing section 1410; a direction adjustment driving section 1440 actuated by the direction adjusting signal which is transmitted from the control section 1430; and a direction adjusting jig section 1450 driven by the direction adjustment driving section 1440 for adjusting a direction of the container end 120.

The sensing section 1410 is composed of, for example, an image sensor for sensing a configuration of the container end 120. The sensing section 1410 outputs an image signal which is obtained by sensing the configuration of the container end 120, to the control section 1430. The control section 1430 compares the image signal which is transmitted from the sensing section 1410, with the image data signal of the corresponding container end 120, and creates the direction adjusting signal when the image signal sensed by the sensing section 1410 is different from the image data signal stored in the memory section 1420. Thereupon, the direction adjustment is effected by the direction adjustment driving section 1440 and the direction adjusting jig section 1450, whereby the container cover inserting operation which is performed by the container cover inserting device 1500 can be reliably implemented. For example, the image sensor photographs a direction of the pull tab 122 which is coupled to the upper surface of the container end 120. The direction which is photographed or imaged by the sensing section 1410 is compared with the data direction of the pull tab 122 which is stored in the memory section 1420, if the two direction are not coincident with each other, the direction of the container end 120 is adjusted, whereby it is possible to feed the container ends 120 which are always aligned in the same predetermined direction, into the container cover inserting device 1500.

The sensing section 1410 should not be understood as being limitedly composed of the image sensor. Instead, the sensing section can be composed of a proximity sensor.

The container cover inserting device 1500 comprises a container end fixing section 1510 for fixedly maintaining the container end 120 in a manner such that it does not fluctuate; a tab lifting section 1520 inserted between the upper surface of the container end 120 which is fixedly maintained by the container end fixing section 1510 and the pull tab 122 for slantingly lifting the pull tab 122 at the predetermined angle, the tab lifting section 1520 being returned to its original position after the container cover 130 is inserted between the upper surface of the container end 120 and the pull tab 122; and a container cover inserting section 1530 for loading and inserting the container cover 130 between the upper surface of the container end 120 and the pull tab 122 in a state wherein the pull tab 122 is lifted.

The container end fixing section 1510 can comprise a jig which is able to grasp both sides of the container end 120 or a robot arm which is able to fix the container end 120, etc.

The tab lifting section 1520 can be constructed to have a shape as represented by the drawing reference numeral A in FIG. 10, thereby to effect lifting of the pull tab 122.

The container cover inserting section 1530 can comprise a variety of jigs, robot arms, or the like, capable of grasping the container cover 130 which is formed by the container cover forming facility, for example, the press and then transferred by the conveyor system, or is formed by the container cover forming facility and then received in a storing receptacle, inserting the container cover 110 between the container end 120 and the pull tab 122, and then returning to its original position.

Hereinafter, operations of the apparatus for mounting a container cover mountable to a beverage container, will be described in detail.

As shown in FIGS. 11*a* and 11*b*, after the container covers 130 which are formed by the container cover forming process and transferred by the conveyor system, or are formed by the container cover forming process and received in the storing receptacle, are supplied onto an upper surface of the container end loading device 1300, the plurality of container ends 120 are fed at a predetermined speed along their paths.

While the container ends 120 are fed as described above, the sensing section 1410 of the container end sensing and aligning device 1400 senses a configuration of the container end 120, creates an image signal for the configuration of the container end 120 and transmits the image signal to the control section 1430.

The control section 1430 compares the image signal of the configuration of the container end 120 which is sensed by the sensing section 1410, with the data signal for the configuration which is stored in the memory section 1420, creates the direction adjusting signal if the two signals are not the same, and transmits the direction adjusting signal to the direction adjustment driving section 1440 thereby to drive the direction adjustment jig section 1450. By this, the direction of the container end 120 is adjusted to be the same as that which is stored in the memory section 1420.

The container end 120 which is adjusted in its direction as described above, is fed into the container cover inserting device 1500 and then inserted between the upper surface of the container end 120 and the pull tab 122. Describing this procedure more detail, in a state wherein the container end 120 is fixedly maintained by the container end fixing section 1510 not to be fluctuated, the tab lifting section 1520 lifts the pull tab 122 which is installed on the upper surface of the container end 120 by the predetermined angle. In this situation, the container cover insertion section 1530 grasps the container cover 130 which is formed by the container cover forming facility, for example, the press and then transferred by the conveyor system, or is formed by the container cover forming facility and then received in the storing receptacle, inserts the container cover 130 between the container end 120 and the pull tab 122, and then returns to its original position. By this, as the pull tab 122 is also returned to its original position by its own elasticity, the mounting operation of the container cover 130 is completed.

The container ends 120 to which the container covers 130 are mounted, respectively, are arranged by the container end arranging and storing device 1600 in the predetermined pattern and then received in a storage.

On the other hand, as the container end 120 to which the container cover 130 is mounted, is coupled to the upper end of the body 110 of the beverage container 100 in which the beverage is accommodated, the manufacturing of the beverage container 100 is completed.

As described above, the container cover mountable to a beverage container and a mounting method and apparatus thereof according to the present invention provide advantages in that, since it is possible to selectively reclose with the container cover an opened discharging hole defined in a container end surface, entrance of foreign substances into the beverage container is avoided. Also, because the container cover is formed with at least one filtering hole and a straw insertion hole, a higher grade of satisfaction can be rendered to a user. Moreover, due to the fact that the container cover is provided with an advertising function, advertising effectiveness can be maximized. Furthermore, according to the present invention, it is possible to prevent a fingernail of the user from being damaged in the course of manipulating a pull tab for opening the discharging hole of the beverage container, whereby the discharging hole of the beverage container can be opened in an easier manner. In addition, by the method and apparatus according to the present invention, the container cover can be rotatably coupled to the container end of the beverage container.

In the drawings and specification, there have been disclosed typical preferred embodiments of the invention and, although specific terms are employed, they are used in a generic and descriptive sense only and not for purposes of limitation, the scope of the invention being set forth in the following claims.

What is claimed is:

1. A method for mounting a container cover which is mountable to a beverage container, comprising the processes of:

forming a body of the beverage container, in which a beverage is to be accommodated;

forming a container end which is to be coupled to an upper end of the body of the beverage container, the container end coupled with a pull tab via a central pin, the pull tab having a lift end capable of being lifted to leverage the pull tab across the central pin and against the container end for opening a discharging part and thereby defining a discharging hole, the discharging hole allowing the beverage to be discharged out of the beverage container therethrough;

coupling the container end to the upper end of the body of the beverage container in a state wherein the beverage is accommodated in the body of the beverage container;

forming a container cover which is composed of a body of substantially a disc-shaped configuration, the body being formed at least with a beverage discharging opening and a straw insertion hole, the body defining a rotation guiding part sized to fit about the central pin, the container cover forming process comprising:

forming a plurality of tab lifting projections;

forming a straw supporting member; and providing a film member in the straw insertion hole; and rotatably coupling the container cover to the central pin between an upper surface of the container end and the pull tab, while the container end forming process is implemented.

2. The method as claimed in claim 1, wherein the container cover forming process is implemented using a press; and wherein the method further comprises:

loading the container cover using a loading device, thereby enabling the container cover to be supplied onto the tipper surface of the container end.

3. The method as claimed in claim 2, further comprising the process of:

forming an advertisement on an upper surface of the container cover substantially simultaneously with the container cover forming process.

4. The method as claimed in claim 1, wherein before the pull tab is coupled to the upper surface of the container end, the pull tab and the container cover are loaded on the upper surface of the container end, whereby, as the pull tab is installed on the container end using a central pin, the container cover is supported along with the pull tab by the central pin.

5. The method as claimed in claim 1, further comprising the process of:

forming fluctuation preventing means located on the container cover such that the container cover is maintained in place relative to the container end while the container cover is rotatably coupled to the upper surface of the container end.

6. The method as claimed in claim 5, wherein the fluctuation preventing means comprises a pair of engaging grooves which are formed in the container cover in a manner such that a pair of tab fixing projections which project out of the tipper surface of the container end are engaged into the pair of engaging grooves, respectively.

7. The method as claimed in claim 1, further comprising:

before the pull tab is loaded on and coupled to the upper surface of the container end, loading the container cover on the upper surface of the container end.

8. A method for mounting a container cover which is mountable to a beverage container, comprising the steps of:

loading a container end, the container end having a pull tab coupled to an upper surface of the container end via a central pin, the pull tab providing leveraging means for opening a discharging opening in the container end when an end of the pull tab is lifted;

moving the loaded container end in a predetermined direction;

sensing and aligning in a predetermined orientation the moved container end; and mounting a container cover between an upper surface of the container end and a pull tab around the central pin, the container cover comprising a body of substantially a disc-shaped configuration, the container cover having apertures selectively formed in the body, the apertures including a beverage discharging opening, a plurality of filtering holes and a straw insertion hole, the beverage discharging opening being formed in such a manner that it is communicated with the discharging hole, thereby allowing a beverage accommodated in the beverage container to be discharged out of the beverage container through the discharging opening, the plurality of filtering holes being formed in a manner such that solid matters existing in the beverage container can be filtered, and the straw insertion hole being perforated to have a predetermined diameter in a manner such that a straw can be inserted through the straw insertion hole and into the discharging opening when the container cover is rotated so as to align the straw insertion hole with the discharging opening, the container cover mounting step comprising:

fixedly maintaining the container end which is moved, thereby to prevent the container end from fluctuating;

slantingly lifting the pull tab at a predetermined angle, the pull tab being coupled to the upper end of the fixed container end; and inserting the container cover between the lifted pull tab and the upper surface of the fixed container end.

9. The method as claimed in claim 8, further comprising the step of:

arranging and storing in a predetermined pattern container ends each of which has a container cover inserted thereinto by the container cover inserting step.

10. A method for mounting a container cover which is mountable to a beverage container, comprising the processes of:

forming a body of the beverage container, in which a beverage is to be accommodated;

forming a container end which is to be coupled to an upper end of the body of the beverage container, the container end coupled with a pull tab via a central pin, the pull tab having a lift end capable of being lifted to leverage the pull tab across the central pin and against the container end for opening a discharging part and thereby defining a discharging hole, the discharging hole allowing the beverage to be discharged out of the beverage container therethrough;

coupling the container end to the upper end of the body of the beverage container in a state wherein the beverage is accommodated in the body of the beverage container;

forming a container cover comprising a body of substantially a disc-shaped configuration, the body being formed at least with a beverage discharging opening and a straw insertion hole, the body defining a rotation guiding part sized to fit about the central pin;

forming fluctuation preventing means located on the container cover such that the container cover is maintained in place relative to the container end while the container cover is rotatably coupled to the upper surface of the container end, wherein the fluctuation preventing means comprises a pair of engaging grooves which are formed in the container cover in a manner such that a pair of tab fixing projections which project out of the upper surface of the container end are engaged into the pair of engaging grooves, respectively; and rotatably coupling the container cover to the central pin between an upper surface of the container end and the pull tab, while the container end forming process is implemented.

11. The method as claimed in claim 10, wherein the container cover forming process includes the sub-processes of forming a plurality of tab lifting projections, forming a straw supporting member, and providing a film member in the straw insertion hole.

12. The method as claimed in claim 10, further comprising the process of:

forming an advertisement on an upper surface of the container cover substantially simultaneously with the container cover forming process.

13. The method as claimed in claim 10, wherein the container cover forming process is implemented using a press; and wherein the method further comprises:

loading the container cover using a loading device, thereby enabling the container cover to be supplied onto the upper surface of the container end.

14. The method as claimed in claim 10, wherein before the pull tab is coupled to the upper surface of the container end, the pull tab and the container cover are loaded on the upper surface of the container end, whereby, as the pull tab is installed on the container end using a central pin, the container cover is supported along with the pull tab by the central pin.

* * * * *

UNITED STATES PATENT AND TRADEMARK OFFICE

CERTIFICATE OF CORRECTION

PATENT NO. : 6,386,814 B2
DATED : May 14, 2002
INVENTOR(S) : Jong Hoon Song

It is certified that error appears in the above-identified patent and that said Letters Patent is hereby corrected as shown below:

Column 15,
Lines 16 and 17, delete "is returned it" and insert -- is returned to --

Column 17,
Line 15, delete "direction" and insert -- directions --
Line 49, delete "110" and insert -- 130 --

Signed and Sealed this

Ninth Day of August, 2005

JON W. DUDAS
*Director of the United States Patent and Trademark Office*